US008281882B2

(12) United States Patent
Hall et al.

(10) Patent No.: US 8,281,882 B2
(45) **Date of Patent: *Oct. 9, 2012**

(54) JACK ELEMENT FOR A DRILL BIT

(75) Inventors: David R. Hall, Provo, UT (US); Francis E. Leany, Salem, UT (US); Joe Fox, Spanish Fork, UT (US); Tyson J. Wilde, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 158 days.

This patent is subject to a terminal disclaimer.

(21) Appl. No.: 12/475,344

(22) Filed: May 29, 2009

(65) Prior Publication Data

US 2009/0260894 A1 Oct. 22, 2009

Related U.S. Application Data

(63) Continuation of application No. 11/535,036, filed on Sep. 25, 2006, now Pat. No. 7,571,780, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 10/26* (2006.01)

(52) U.S. Cl. ..... 175/385; 175/404; 175/426

(58) Field of Classification Search ..... 175/385, 175/408, 404, 426

See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 572,735 | A | 12/1896 | Thompson |
| 590,113 | A | 9/1897 | Prindle |
| 923,513 | A | 6/1909 | Hardsocg |
| 946,060 | A | 1/1910 | Looker |

(Continued)

OTHER PUBLICATIONS

PCT/US06/43125, International Search Report dated May 27, 2008.

(Continued)

*Primary Examiner* — Hoang Dang
(74) *Attorney, Agent, or Firm* — Osha • Liang LLP

(57) ABSTRACT

A drill bit has an axis of rotation and a working face with a plurality of blades extending outwardly from a bit body. The blades form, in part, an inverted conical region, and a plurality of cutters with a cutting surface is arrayed along the blades. A jack element is coaxial with the axis of rotation and extends within the inverted conical region within a range defined by the cutting surface of at least one cutter.

12 Claims, 12 Drawing Sheets

U.S. PATENT DOCUMENTS

| | | | |
|---|---|---|---|
| 1,116,154 | A | 11/1914 | Stowers |
| 1,183,630 | A | 5/1916 | Bryson |
| 1,189,560 | A | 7/1916 | Gondos |
| 1,258,418 | A | 3/1918 | Kemble |
| 1,360,908 | A | 11/1920 | Everson |
| 1,372,257 | A | 3/1921 | Swisher |
| 1,387,733 | A | 8/1921 | Midgett |
| 1,460,671 | A | 7/1923 | Hebsacker |
| 1,544,757 | A | 7/1925 | Hufford |
| 1,619,328 | A | 3/1927 | Benckenstein |
| 1,712,948 | A | 5/1929 | Burch |
| 1,746,455 | A | 2/1930 | Woodruff |
| 1,746,456 | A | 2/1930 | Allington |
| 2,169,223 | A | 8/1931 | Christian |
| 1,821,474 | A | 9/1931 | Mercer |
| 1,836,638 | A | 12/1931 | Wright |
| 1,879,117 | A | 9/1932 | Gault |
| 1,879,177 | A | 9/1932 | Gault |
| 1,921,135 | A | 8/1933 | Santiago |
| 2,022,101 | A | 11/1935 | Wright |
| 2,054,255 | A | 9/1936 | Howard |
| 2,064,255 | A | 12/1936 | Garfield |
| 2,100,692 | A | 11/1937 | Harman |
| 2,121,202 | A | 6/1938 | Killgore |
| 2,153,034 | A | 4/1939 | Baker |
| 2,170,452 | A | 8/1939 | Grant |
| 2,196,657 | A | 4/1940 | Burt |
| 2,196,940 | A | 4/1940 | Potts |
| 2,199,692 | A | 5/1940 | Catland |
| 2,216,130 | A | 10/1940 | Court |
| 2,218,130 | A | 10/1940 | Court |
| 2,227,233 | A | 12/1940 | Scott/Noble et al. |
| 2,300,016 | A | 10/1942 | Scott et al. |
| 2,320,136 | A | 5/1943 | Kammerer |
| 2,320,670 | A | 6/1943 | Scaramucci |
| 2,345,024 | A | 3/1944 | Bannister |
| 2,371,248 | A | 3/1945 | McNamara |
| 2,375,335 | A | 5/1945 | Walker |
| 2,414,719 | A | 1/1947 | Cloud |
| 2,427,052 | A | 9/1947 | Grant |
| 2,466,991 | A | 4/1949 | Kammerer |
| 2,498,192 | A | 2/1950 | Wright |
| 2,540,464 | A | 2/1951 | Stokes |
| 2,544,036 | A | 3/1951 | Kammerer |
| 2,544,336 | A | 3/1951 | Kammerer |
| 2,545,036 | A | 3/1951 | Kammerer |
| 2,575,173 | A | 11/1951 | Johnson |
| 2,578,593 | A | 12/1951 | Phipps |
| 2,615,519 | A | 10/1952 | Carr |
| 2,619,325 | A | 11/1952 | Arutunoff |
| 2,626,780 | A | 1/1953 | Ortloff |
| 2,643,860 | A | 6/1953 | Koch |
| 2,725,215 | A | 11/1955 | Macneir |
| 2,735,653 | A | 2/1956 | Bielstein |
| 2,737,244 | A | 3/1956 | Baker et al. |
| 2,746,721 | A | 5/1956 | Moore |
| 2,755,071 | A | 7/1956 | Kammerer |
| 2,776,819 | A | 1/1957 | Brown |
| 2,807,443 | A | 9/1957 | Wyman |
| 2,815,932 | A | 12/1957 | Wolfram |
| 2,819,041 | A | 1/1958 | Beckham |
| 2,819,043 | A | 1/1958 | Henderson |
| 2,838,284 | A | 6/1958 | Austin |
| 2,868,511 | A | 1/1959 | Barrett |
| 2,873,093 | A | 2/1959 | Hildebrandt |
| 2,877,984 | A | 3/1959 | Causey |
| 2,894,722 | A | 7/1959 | Buttolph |
| 2,901,223 | A | 8/1959 | Scott |
| 2,940,039 | A | 6/1960 | Yost et al. |
| 2,942,850 | A | 6/1960 | Heath |
| 2,942,851 | A | 6/1960 | Beck |
| 2,963,102 | A | 12/1960 | Smith |
| 2,998,085 | A | 8/1961 | Dulaney |
| 3,001,584 | A | 9/1961 | Scott |
| 3,036,645 | A | 5/1962 | Rowley |
| 3,039,531 | A | 6/1962 | Scott |
| 3,054,415 | A | 9/1962 | Baker et al. |
| 3,055,443 | A | 9/1962 | Edwards |
| 3,058,532 | A | 10/1962 | Alder |
| 3,059,708 | A | 10/1962 | Cannon et al. |
| 3,075,592 | A | 1/1963 | Overly |
| 3,077,936 | A | 2/1963 | Arutunoff |
| 3,105,560 | A | 10/1963 | Zublin |
| 3,126,065 | A | 3/1964 | Chadderdon |
| 3,130,783 | A | 4/1964 | Orr |
| 3,135,341 | A | 6/1964 | Ritter |
| 3,139,147 | A | 6/1964 | Hays |
| 3,163,243 | A | 12/1964 | Cleary |
| 3,187,191 | A | 6/1965 | Baggs |
| 3,199,617 | A | 8/1965 | White |
| 3,216,514 | A | 11/1965 | Nelson |
| 3,251,424 | A | 5/1966 | Brooks |
| 3,294,186 | A | 12/1966 | Buetl |
| 3,301,339 | A | 1/1967 | Pennebaker |
| 3,303,899 | A | 2/1967 | Jones, Jr. et al. |
| 3,336,988 | A | 8/1967 | Jones, Jr. |
| 3,342,267 | A | 9/1967 | Cotter et al. |
| 3,346,060 | A | 10/1967 | Rex |
| 3,362,488 | A | 1/1968 | Jury et al. |
| 3,379,264 | A | 4/1968 | Cox |
| 3,387,673 | A | 6/1968 | Thompson |
| 3,403,729 | A | 10/1968 | Hickey |
| 3,429,390 | A | 2/1969 | Bennett |
| 3,433,331 | A | 3/1969 | Heyberger |
| 3,455,158 | A | 7/1969 | Richter |
| 3,493,165 | A | 2/1970 | Schonfield |
| 3,583,504 | A | 6/1971 | Aalund |
| 3,635,296 | A | 1/1972 | Lebourg |
| 3,667,556 | A | 6/1972 | Henderson |
| 3,688,852 | A | 9/1972 | Gaylord |
| 3,700,049 | A | 10/1972 | Tiraspolsky et al. |
| 3,703,104 | A | 11/1972 | Tamplen |
| 3,732,143 | A | 5/1973 | Joosse |
| 3,758,731 | A | 9/1973 | Vann et al. |
| 3,764,493 | A | 10/1973 | Rosar |
| 3,765,493 | A | 10/1973 | Rosar et al. |
| 3,807,512 | A | 4/1974 | Pogonowski |
| 3,815,692 | A | 6/1974 | Varley |
| 3,821,993 | A | 7/1974 | Kniff |
| 3,823,773 | A | 7/1974 | Nutter |
| 3,885,638 | A | 5/1975 | Skidmore et al. |
| 3,899,033 | A | 8/1975 | Van Huisen |
| 3,936,683 | A | 2/1976 | Walker |
| 3,955,535 | A | 5/1976 | Stock |
| 3,955,635 | A | 5/1976 | Skidmore |
| 3,960,223 | A | 6/1976 | Kleine |
| 3,967,201 | A | 6/1976 | Rorden |
| 3,971,450 | A | 7/1976 | Fox |
| 3,978,931 | A | 9/1976 | Sudnishnikov et al. |
| 3,986,554 | A | 10/1976 | Nutter |
| 3,989,114 | A | 11/1976 | Tschirky |
| 4,007,797 | A | 2/1977 | Jeter |
| 4,015,234 | A | 3/1977 | Krebs |
| 4,033,408 | A | 7/1977 | Fredd et al. |
| 4,081,042 | A | 3/1978 | Johnson |
| 4,096,917 | A | 6/1978 | Harris |
| 4,106,577 | A | 8/1978 | Summer |
| 4,109,737 | A | 8/1978 | Bovenkerk |
| RE30,055 | E | 7/1979 | Claycomb |
| 4,165,790 | A | 8/1979 | Emmerich |
| 4,173,457 | A | 11/1979 | Smith |
| 4,176,723 | A | 12/1979 | Arceneaux |
| 4,186,628 | A | 2/1980 | Bonnice |
| 4,207,485 | A | 6/1980 | Silver |
| 4,207,964 | A | 6/1980 | Taguchi |
| 4,211,291 | A | 7/1980 | Kellner |
| 4,253,533 | A | 3/1981 | Baker |
| 4,262,758 | A | 4/1981 | Evans |
| 4,266,605 | A | 5/1981 | LaBorde et al. |
| 4,277,707 | A | 7/1981 | Silver et al. |
| 4,280,573 | A | 7/1981 | Sudnishnikov |
| 4,283,779 | A | 8/1981 | Lamel |
| 4,304,312 | A | 12/1981 | Larsson |
| 4,307,786 | A | 12/1981 | Evans |
| 4,386,669 | A | 6/1983 | Evans |
| 4,397,361 | A | 8/1983 | Langford |
| 4,416,339 | A | 11/1983 | Baker |

4,416,494 A 11/1983 Watkins et al.
4,445,580 A 5/1984 Sahley
4,448,269 A 5/1984 Ishikawa
4,462,469 A 7/1984 Brown
4,478,296 A 10/1984 Richman
4,491,187 A 1/1985 Russell
4,491,738 A 1/1985 Kamp
4,499,795 A 2/1985 Radtke
4,520,870 A 6/1985 Pringle
4,531,592 A 7/1985 Hayatdavoudi
4,532,614 A 7/1985 Peppers
4,535,853 A 8/1985 Ippolito
4,538,691 A 9/1985 Dennis
4,564,068 A 1/1986 Baugh
4,566,545 A 1/1986 Story
4,574,894 A 3/1986 Jadwin
4,574,895 A 3/1986 Dolezal
4,578,675 A 3/1986 MacLeod
4,583,592 A 4/1986 Gazda et al.
4,592,432 A 6/1986 Williams et al.
4,596,293 A 6/1986 Wallussek et al.
4,597,454 A 7/1986 Schoeffler
4,612,987 A 9/1986 Cheek
4,615,399 A 10/1986 Schoeffler
4,624,306 A 11/1986 Traver
4,632,193 A 12/1986 Geczy
4,637,479 A 1/1987 Leising
4,640,374 A 2/1987 Dennis
4,655,289 A 4/1987 Schoeffler
4,676,310 A 6/1987 Scherbatskoy et al.
4,679,637 A 7/1987 Cherrington
4,683,781 A 8/1987 Kar et al.
4,694,913 A 9/1987 McDonald
4,720,640 A 1/1988 Anderson et al.
4,721,172 A 1/1988 Brett et al.
4,722,661 A 2/1988 Mizuno
4,729,441 A 3/1988 Peetz et al.
4,732,223 A 3/1988 Schoeffler
4,732,225 A 3/1988 Jurgens et al.
4,732,226 A 3/1988 Ebeling
4,733,734 A 3/1988 Bardin
4,754,181 A 6/1988 Mizobuchi et al.
4,765,419 A 8/1988 Scholz et al.
4,775,017 A 10/1988 Forrest
4,782,894 A 11/1988 LaFleur
4,785,247 A 11/1988 Meador et al.
4,788,544 A 11/1988 Howard
4,802,150 A 1/1989 Russell et al.
4,806,928 A 2/1989 Veneruso
4,817,739 A 4/1989 Jeter
4,819,745 A 4/1989 Walter
4,821,819 A 4/1989 Whysong
4,830,122 A 5/1989 Walter
4,836,301 A 6/1989 Van Dongen et al.
4,852,672 A 8/1989 Behrens
4,858,706 A 8/1989 Lebourgh
4,869,100 A 9/1989 Birdwell
4,875,531 A 10/1989 Biehl
4,889,017 A 12/1989 Fuller
4,889,199 A 12/1989 Lee
4,893,678 A 1/1990 Stokley et al.
4,895,214 A 1/1990 Schoeffler
4,907,665 A 3/1990 Kar et al.
4,924,499 A 5/1990 Serby
4,924,949 A 5/1990 Curlett
4,928,520 A 5/1990 Barrington
4,938,297 A 7/1990 Schmidt
4,962,822 A 10/1990 Pascale
4,965,998 A 10/1990 Estigoy et al.
4,974,688 A 12/1990 Helton
4,979,577 A 12/1990 Walter
4,981,184 A 1/1991 Knowlton
4,991,667 A 2/1991 Wilkes et al.
4,991,670 A 2/1991 Fuller
5,009,273 A 4/1991 Grabinski
5,027,914 A 7/1991 Wilson
5,038,873 A 8/1991 Jurgens
5,052,503 A 10/1991 Lof
5,088,568 A 2/1992 Simuni
5,090,944 A 2/1992 Kyo et al.
5,094,304 A 3/1992 Briggs
5,098,258 A 3/1992 Barnetche-Gonzalez
5,099,927 A 3/1992 Gibson et al.
5,103,919 A 4/1992 Warren
5,112,188 A 5/1992 Barnetche-Gonzalez
5,119,892 A 6/1992 Clegg
5,135,060 A 8/1992 Ide
5,141,063 A 8/1992 Quesenbury
5,148,875 A 9/1992 Karlsson
5,163,520 A 11/1992 Gibson et al.
5,176,212 A 1/1993 Tandberg
5,186,268 A 2/1993 Clegg
5,189,645 A 2/1993 Innes
5,193,628 A 3/1993 Hill
5,222,566 A 6/1993 Taylor
5,230,390 A 7/1993 Zastresek et al.
5,232,058 A 8/1993 Morin et al.
5,248,896 A 9/1993 Forrest
5,255,749 A 10/1993 Bumpurs
5,259,469 A 11/1993 Stjernstrom
5,265,682 A 11/1993 Russell
5,270,600 A 12/1993 Hashimoto
5,311,953 A 5/1994 Walker
5,314,030 A 5/1994 Peterson et al.
5,316,094 A 5/1994 Pringle
5,332,051 A 7/1994 Knowlton
5,337,002 A 8/1994 Mercer
5,361,859 A 11/1994 Tibbitts
5,388,649 A 2/1995 Iiomaki
5,392,862 A 2/1995 Swearingen
5,410,303 A 4/1995 Comeau
5,415,030 A 5/1995 Jogi
5,417,292 A 5/1995 Polakoff
5,423,389 A 6/1995 Warren
5,443,128 A 8/1995 Amaudric du Chaffaut
5,475,309 A 12/1995 Hong
5,499,687 A 3/1996 Lee
5,507,357 A 4/1996 Hult
5,517,464 A 5/1996 Lerner et al.
5,535,839 A 7/1996 Brady
5,539,258 A 7/1996 Sutton et al.
5,553,678 A 9/1996 Barr
5,560,440 A 10/1996 Tibbitts
5,568,838 A 10/1996 Struthers
5,584,342 A 12/1996 Swinford
5,609,178 A 3/1997 Hennig et al.
5,626,200 A 5/1997 Gilbert et al.
5,642,782 A 7/1997 Grimshaw
5,655,614 A 8/1997 Azar
5,673,763 A 10/1997 Thorp
5,678,644 A 10/1997 Fielder
5,685,379 A 11/1997 Barr et al.
5,695,015 A 12/1997 Barr et al.
5,706,905 A 1/1998 Barr
5,720,355 A 2/1998 Lamine
5,728,420 A 3/1998 Keogh
5,730,222 A 3/1998 Rike, Jr.
5,732,784 A 3/1998 Nelson
5,758,731 A 6/1998 Zollinger
5,758,732 A 6/1998 Liw
5,762,156 A 6/1998 Bates et al.
5,778,991 A 7/1998 Runquist
5,794,728 A 8/1998 Palmberg
5,803,185 A 9/1998 Barr et al.
5,803,193 A 9/1998 Krueger et al.
5,806,611 A 9/1998 Van Den Steen
5,833,002 A 11/1998 Holcombe
5,833,021 A 11/1998 Mensa-Wilmot
5,839,508 A 11/1998 Tubel et al.
5,848,657 A 12/1998 Flood et al.
5,856,790 A 1/1999 Baugh et al.
5,864,058 A 1/1999 Chen
5,896,938 A 4/1999 Moeny
5,901,113 A 5/1999 Masak
5,901,796 A 5/1999 McDonald
5,904,444 A 5/1999 Kabeuchi et al.
5,924,499 A 7/1999 Birchak et al.
5,947,215 A 9/1999 Lundell 5,950,743 A 9/1999 Cox
5,957,223 A 9/1999 Doster
5,957,225 A 9/1999 Sinor
5,965,964 A 10/1999 Skinner et al.
5,967,247 A 10/1999 Pessier
5,979,571 A 11/1999 Scott
5,992,547 A 11/1999 Caraway
5,992,548 A 11/1999 Silva
6,003,623 A 12/1999 Miess
6,011,334 A 1/2000 Roland
6,021,589 A 2/2000 Cagliari et al.
6,021,859 A 2/2000 Tibbitts
6,030,004 A 2/2000 Schock et al.
6,039,131 A 3/2000 Beaton
6,047,239 A 4/2000 Berger
6,050,350 A 4/2000 Morris
6,089,332 A 7/2000 Barr et al.
6,092,610 A 7/2000 Kosmala et al.
6,123,561 A 9/2000 Turner et al.
6,131,675 A 10/2000 Anderson
6,142,250 A 11/2000 Griffin et al.
6,150,822 A 11/2000 Hong
6,161,631 A 12/2000 Kennedy
6,186,251 B1 2/2001 Butcher
6,196,340 B1 3/2001 Jensen et al.
6,199,645 B1 3/2001 Anderson et al.
6,202,761 B1 3/2001 Forney
6,213,225 B1 4/2001 Chen
6,213,226 B1 4/2001 Eppink
6,220,079 B1 4/2001 Taylor et al.
6,223,824 B1 5/2001 Moyes
6,223,826 B1 5/2001 Chau et al.
6,253,847 B1 7/2001 Stephenson
6,253,864 B1 7/2001 Hall
6,269,893 B1 8/2001 Beaton
6,290,007 B2 9/2001 Beuershausen et al.
6,296,069 B1 10/2001 Lamine et al.
6,298,930 B1 10/2001 Sinor
6,321,858 B1 11/2001 Wentworth
6,332,503 B1 12/2001 Pessier et al.
6,340,064 B2 1/2002 Fielder
6,363,780 B1 4/2002 Rey-Fabret
6,364,034 B1 4/2002 Schoeffler
6,364,038 B1 4/2002 Driver
6,367,564 B1 4/2002 Mills et al.
6,382,330 B2 5/2002 Bischel et al.
6,388,346 B1 5/2002 Lopatinsky et al.
6,390,200 B1 5/2002 Allamon et al.
6,392,317 B1 5/2002 Hall et al.
6,394,200 B1 5/2002 Watson
6,408,959 B2 6/2002 Bertagnolli et al.
6,419,014 B1 7/2002 Meek et al.
6,431,270 B1 8/2002 Angle
6,443,249 B2 9/2002 Beuershausen
6,446,728 B2 9/2002 Chau et al.
6,450,269 B1 9/2002 Wentworth
6,454,030 B1 9/2002 Findley et al.
6,466,513 B1 10/2002 Pabon et al.
6,467,341 B1 10/2002 Boucher
6,474,425 B1 11/2002 Truax
6,484,819 B1 11/2002 Harrison
6,484,825 B2 11/2002 Watson
6,484,826 B1 11/2002 Anderson et al.
6,495,929 B2 12/2002 Bosley et al.
6,502,650 B1 1/2003 Beccu
6,510,906 B1 1/2003 Richert
6,513,606 B1 2/2003 Krueger
6,533,050 B2 3/2003 Molloy
6,550,534 B2 4/2003 Brett
6,561,289 B2 5/2003 Portman et al.
6,571,888 B2 6/2003 Comeau et al.
6,575,236 B1 6/2003 Heinjen
6,581,699 B1 6/2003 Chen et al.
6,588,518 B2 7/2003 Eddison
6,594,881 B2 7/2003 Tibbitts
6,601,454 B1 8/2003 Botnan
6,601,662 B2 8/2003 Matthias et al.
6,619,388 B2 9/2003 Dietz et al.
6,622,803 B2 9/2003 Harvey
6,634,388 B1 10/2003 Taylor et al.
6,651,755 B1 11/2003 Kelpe
6,652,202 B2 11/2003 Remke
6,655,464 B2 12/2003 Chau et al.
6,668,949 B1 12/2003 Rives
6,670,880 B1 12/2003 Hall et al.
6,672,406 B2 1/2004 Beuershausen
6,672,409 B1 1/2004 Dock et al.
6,688,396 B2 2/2004 Floerke et al.
6,698,537 B2 3/2004 Pascale
6,717,283 B2 4/2004 Skinner et al.
6,717,501 B2 4/2004 Hall et al.
6,729,420 B2 5/2004 Mensa-Wilmot
6,732,817 B2 5/2004 Dewey
6,739,413 B2 5/2004 Sharp et al.
6,745,844 B2 6/2004 Henderson
6,749,031 B2 6/2004 Klemm
6,776,240 B2 8/2004 Kenison et al.
6,789,635 B2 9/2004 Wentworth
6,794,777 B1 9/2004 Fradella
6,799,632 B2 10/2004 Hall et al.
6,814,162 B2 11/2004 Moran et al.
6,820,697 B1 11/2004 Churchill
6,821,147 B1 11/2004 Hall et al.
6,822,579 B2 11/2004 Goswani
6,830,467 B2 12/2004 Hall et al.
6,844,498 B2 1/2005 Hall et al.
6,845,822 B2 1/2005 Chau
6,848,503 B2 2/2005 Schultz et al.
6,854,953 B2 2/2005 Van Drentham-Susman et al.
6,863,124 B2 3/2005 Araux et al.
6,880,648 B2 4/2005 Edscer
6,880,649 B2 4/2005 Edscer
6,888,473 B1 5/2005 Hall et al.
6,913,093 B2 7/2005 Hall et al.
6,913,095 B2 7/2005 Krueger
6,920,930 B2 7/2005 Allamon et al.
6,929,076 B2 8/2005 Fanuel et al.
6,929,493 B2 8/2005 Hall et al.
6,945,802 B2 9/2005 Hall et al.
6,948,572 B2 9/2005 Hay
6,953,096 B2 10/2005 Gledhill
6,968,611 B2 11/2005 Hall et al.
6,994,175 B2 2/2006 Egerstrom
7,013,994 B2 3/2006 Eddison
7,025,155 B1 4/2006 Estes
7,028,779 B2 4/2006 Chau
7,036,611 B2 5/2006 Radford et al.
7,048,078 B2 5/2006 Dewey et al.
7,073,610 B2 7/2006 Susman
7,096,980 B2 8/2006 Trevas
7,104,344 B2 9/2006 Kriesels
7,133,325 B2 11/2006 Kotsonis et al.
7,150,329 B2 12/2006 Chau
7,165,608 B2 1/2007 Schultz et al.
7,190,084 B2 3/2007 Hall et al.
7,193,526 B2 3/2007 Hall et al.
7,198,119 B1 4/2007 Hall et al.
7,201,239 B1 4/2007 Perry
7,204,560 B2 4/2007 Mercier et al.
7,207,398 B2 4/2007 Runia
7,219,747 B2 5/2007 Gleitman et al.
7,225,886 B1 6/2007 Hall
7,240,744 B1 7/2007 Kemick
7,246,660 B2 7/2007 Fripp et al.
7,258,179 B2 8/2007 Hall
7,261,184 B2 8/2007 Bass et al.
7,270,196 B2 9/2007 Hall
7,308,937 B2 12/2007 Radford et al.
7,328,755 B2 2/2008 Hall et al.
7,331,397 B1 2/2008 Wagley et al.
7,337,858 B2 3/2008 Hall et al.
D566,137 S 4/2008 Hall et al.
7,360,610 B2 4/2008 Hall et al.
7,360,612 B2 4/2008 Chen et al.
7,367,397 B2 5/2008 Clemens et al.
D572,735 S 7/2008 Kammerer
7,398,837 B2 7/2008 Hall et al.
6,439,326 B1 8/2008 Huang

| | | | | |
|---|---|---|---|---|
| 7,419,016 | B2 | 9/2008 | Hall et al. | |
| 7,419,018 | B2 | 9/2008 | Hall | |
| 7,424,922 | B2 | 9/2008 | Hall et al. | |
| 7,426,968 | B2 | 9/2008 | Hall et al. | |
| 7,464,772 | B2 | 12/2008 | Hall et al. | |
| 7,481,281 | B2 | 1/2009 | Schuaf | |
| 7,484,576 | B2 | 2/2009 | Hall et al. | |
| 7,497,279 | B2 | 3/2009 | Hall et al. | |
| 7,503,405 | B2 | 3/2009 | Hall et al. | |
| 7,506,701 | B2 | 3/2009 | Hall et al. | |
| 7,506,706 | B2 | 3/2009 | Hall et al. | |
| 7,510,031 | B2 | 3/2009 | Russell et al. | |
| 7,533,737 | B2 | 5/2009 | Hall et al. | |
| 7,549,489 | B2 | 6/2009 | Hall et al. | |
| 7,559,379 | B2 | 7/2009 | Hall et al. | |
| 7,571,780 | B2 * | 8/2009 | Hall et al. | 175/385 |
| 7,571,782 | B2 | 8/2009 | Hall et al. | |
| 7,600,586 | B2 | 10/2009 | Hall et al. | |
| 7,617,886 | B2 | 11/2009 | Hall et al. | |
| 7,624,824 | B2 | 12/2009 | Hall et al. | |
| 7,637,323 | B2 | 12/2009 | Schasteen et al. | |
| 7,641,002 | B2 | 1/2010 | Hall et al. | |
| 7,641,003 | B2 | 1/2010 | Hall et al. | |
| 7,661,487 | B2 | 2/2010 | Hall et al. | |
| 7,694,756 | B2 * | 4/2010 | Hall et al. | 175/404 |
| 7,730,975 | B2 | 6/2010 | Hall et al. | |
| D620,510 | S | 7/2010 | Hall et al. | |
| 7,753,144 | B2 | 7/2010 | Hall et al. | |
| 2001/0004946 | A1 | 6/2001 | Jensen | |
| 2001/0031178 | A1 | 10/2001 | Remke | |
| 2001/0054515 | A1 | 12/2001 | Eddison et al. | |
| 2002/0050359 | A1 | 5/2002 | Eddison | |
| 2002/0135179 | A1 | 9/2002 | Boyle et al. | |
| 2002/0162654 | A1 | 11/2002 | Bauer et al. | |
| 2003/0042812 | A1 | 3/2003 | Post | |
| 2003/0116969 | A1 | 6/2003 | Skinner et al. | |
| 2003/0192449 | A1 | 10/2003 | Fiske et al. | |
| 2003/0213598 | A1 | 11/2003 | Hughes | |
| 2003/0213621 | A1 | 11/2003 | Britten | |
| 2004/0026983 | A1 | 2/2004 | McAlvain | |
| 2004/0104797 | A1 | 6/2004 | Hall et al. | |
| 2004/0113808 | A1 | 6/2004 | Hall et al. | |
| 2004/0145492 | A1 | 7/2004 | Hall et al. | |
| 2004/0150532 | A1 | 8/2004 | Hall et al. | |
| 2004/0154839 | A1 | 8/2004 | McGarian et al. | |
| 2004/0164833 | A1 | 8/2004 | Hall et al. | |
| 2004/0164838 | A1 | 8/2004 | Hall et al. | |
| 2004/0173381 | A1 | 9/2004 | Moore et al. | |
| 2004/0182366 | A1 | 9/2004 | Andersson et al. | |
| 2004/0216847 | A1 | 11/2004 | Hall et al. | |
| 2004/0222024 | A1 | 11/2004 | Edscer | |
| 2004/0238221 | A1 | 12/2004 | Runia | |
| 2004/0244916 | A1 | 12/2004 | Hall et al. | |
| 2004/0244964 | A1 | 12/2004 | Hall et al. | |
| 2004/0246142 | A1 | 12/2004 | Hall et al. | |
| 2004/0256153 | A1 | 12/2004 | Helms et al. | |
| 2004/0256155 | A1 | 12/2004 | Kriesels | |
| 2005/0001735 | A1 | 1/2005 | Hall et al. | |
| 2005/0001736 | A1 | 1/2005 | Hall et al. | |
| 2005/0001738 | A1 | 1/2005 | Hall et al. | |
| 2005/0011678 | A1 | 1/2005 | Akinlade et al. | |
| 2005/0024231 | A1 | 2/2005 | Fincher et al. | |
| 2005/0035874 | A1 | 2/2005 | Hall et al. | |
| 2005/0035875 | A1 | 2/2005 | Hall et al. | |
| 2005/0035876 | A1 | 2/2005 | Hall et al. | |
| 2005/0036507 | A1 | 2/2005 | Hall et al. | |
| 2005/0039912 | A1 | 2/2005 | Hall et al. | |
| 2005/0045339 | A1 | 3/2005 | Hall et al. | |
| 2005/0046586 | A1 | 3/2005 | Hall et al. | |
| 2005/0046590 | A1 | 3/2005 | Hall et al. | |
| 2005/0067159 | A1 | 3/2005 | Hall et al. | |
| 2005/0070144 | A1 | 3/2005 | Hall et al. | |
| 2005/0072598 | A1 | 4/2005 | Fanuel et al. | |
| 2005/0082092 | A1 | 4/2005 | Hall et al. | |
| 2005/0092499 | A1 | 5/2005 | Hall et al. | |
| 2005/0093296 | A1 | 5/2005 | Hall et al. | |
| 2005/0095827 | A1 | 5/2005 | Hall et al. | |
| 2005/0115717 | A1 | 6/2005 | Hall et al. | |
| 2005/0115718 | A1 | 6/2005 | Symons et al. | |
| 2005/0139393 | A1 | 6/2005 | Maurer et al. | |
| 2005/0145406 | A1 | 7/2005 | Hall et al. | |
| 2005/0145417 | A1 | 7/2005 | Radford et al. | |
| 2005/0150653 | A1 | 7/2005 | Hall et al. | |
| 2005/0155450 | A1 | 7/2005 | Jennings | |
| 2005/0161215 | A1 | 7/2005 | Hall et al. | |
| 2005/0173128 | A1 | 8/2005 | Hall et al. | |
| 2005/0211471 | A1 | 9/2005 | Zupanick | |
| 2005/0212530 | A1 | 9/2005 | Hall et al. | |
| 2005/0236160 | A1 | 10/2005 | Hall et al. | |
| 2005/0284662 | A1 | 12/2005 | Hall et al. | |
| 2006/0016606 | A1 | 1/2006 | Tubel et al. | |
| 2006/0034154 | A1 | 2/2006 | Perry et al. | |
| 2006/0117759 | A1 | 6/2006 | Hall et al. | |
| 2006/0243455 | A1 | 11/2006 | Telfer et al. | |
| 2006/0243493 | A1 | 11/2006 | El-Rayes et al. | |
| 2006/0260797 | A1 | 11/2006 | Hall et al. | |
| 2006/0260798 | A1 | 11/2006 | Hall et al. | |
| 2006/0260801 | A1 | 11/2006 | Hall et al. | |
| 2007/0017671 | A1 | 1/2007 | Clark et al. | |
| 2007/0017679 | A1 | 1/2007 | Wolf et al. | |
| 2007/0056724 | A1 | 3/2007 | Spring et al. | |
| 2007/0062706 | A1 | 3/2007 | Leising | |
| 2007/0079988 | A1 | 4/2007 | Konschuh et al. | |
| 2007/0107944 | A1 | 5/2007 | Lee | |
| 2007/0114067 | A1 | 5/2007 | Hall | |
| 2007/0114068 | A1 | 5/2007 | Hall et al. | |
| 2007/0119630 | A1 | 5/2007 | Hall et al. | |
| 2007/0125580 | A1 | 6/2007 | Hall et al. | |
| 2007/0194948 | A1 | 8/2007 | Hall et al. | |
| 2007/0221406 | A1 | 9/2007 | Hall et al. | |
| 2007/0221409 | A1 | 9/2007 | Hall et al. | |
| 2007/0221412 | A1 | 9/2007 | Hall et al. | |
| 2007/0221415 | A1 | 9/2007 | Hall et al. | |
| 2007/0221416 | A1 | 9/2007 | Hall et al. | |
| 2007/0221417 | A1 | 9/2007 | Hall et al. | |
| 2007/0229232 | A1 | 10/2007 | Hall et al. | |
| 2007/0229304 | A1 | 10/2007 | Hall et al. | |
| 2007/0242565 | A1 | 10/2007 | Hall et al. | |
| 2007/0251696 | A1 | 11/2007 | Parks | |
| 2008/0011521 | A1 | 1/2008 | Hall et al. | |
| 2008/0011522 | A1 | 1/2008 | Hall et al. | |
| 2008/0029312 | A1 | 2/2008 | Hall et al. | |
| 2008/0041597 | A1 | 2/2008 | Fisher et al. | |
| 2008/0099243 | A1 | 5/2008 | Hall et al. | |
| 2008/0105464 | A1 | 5/2008 | Radford | |
| 2008/0142264 | A1 | 6/2008 | Hall et al. | |
| 2008/0142265 | A1 | 6/2008 | Hall et al. | |
| 2008/0173482 | A1 | 7/2008 | Hall et al. | |
| 2008/0217024 | A1 | 9/2008 | Moore | |
| 2008/0296015 | A1 | 12/2008 | Hall et al. | |
| 2008/0302572 | A1 | 12/2008 | Hall et al. | |
| 2008/0314645 | A1 | 12/2008 | Hall et al. | |
| 2009/0044951 | A1 | 2/2009 | Milkovisch et al. | |
| 2009/0056497 | A1 | 3/2009 | Swinford | |
| 2009/0126936 | A1 | 5/2009 | Begley et al. | |
| 2009/0166086 | A1 | 7/2009 | Sugiura | |
| 2009/0260894 | A1 | 10/2009 | Hall et al. | |
| 2010/0000799 | A1 | 1/2010 | Hall et al. | |
| 2010/0132954 | A1 | 6/2010 | Telfer | |
| 2011/0120725 | A1 | 5/2011 | Downton et al. | |
| 2011/0278017 | A1 | 11/2011 | Themig et al. | |

OTHER PUBLICATIONS

PCT/US06/43125, Written Opinion dated May 27, 2008.
PCT/US07/64539, International Search Report and Written Opinion dated Jun. 16, 2008.
PCT/US07/64544, International Search Report dated Aug. 5, 2008.
PCT/US07/84544, Written Opinion dated Aug. 5, 2008.

* cited by examiner

JACK ELEMENT FOR A DRILL BIT

CROSS REFERENCE TO RELATED APPLICATIONS

This patent application is a continuation of U.S. patent application Ser. No. 11/535,036 filed Sep. 25, 2006 and that issued as U.S. Pat. No. 7,571,780 on Aug. 11, 2009, which is a continuation-in-part of U.S. patent application Ser. No. 11/278,935 filed Apr. 6, 2006 and that issued as U.S. Pat. No. 7,426,968 on Sep. 23, 2008, which is a continuation-in-part of U.S. patent application Ser. No. 11/277,394 filed Mar. 24, 2006 and that issued as U.S. Pat. No. 7,398,837 on Jul. 15, 2008, which is a continuation-in-part of U.S. patent application Ser. No. 11/277,380 filed Mar. 24, 2006 and that issued as U.S. Pat. No. 7,337,858 on Mar. 4, 2008, which is a continuation-in-part of U.S. patent application Ser. No. 11/306,976 filed Jan. 18, 2006 and that issued as U.S. Pat. No. 7,360,610 on Apr. 22, 2008, which is a continuation-in-part of U.S. patent application Ser. No. 11/306,307 filed Dec. 22, 2005 and that issued as U.S. Pat. No. 7,225,886 on Jun. 5, 2007, which is a continuation-in-part of U.S. patent application Ser. No. 11/306,022 filed Dec. 14, 2005 and that issued as U.S. Pat. No. 7,198,119 on Apr. 3, 2007, which is a continuation-in-part of U.S. patent application Ser. No. 11/164,391 filed Nov. 21, 2005 and that issued as U.S. Pat. No. 7,270,196 on Sep. 18, 2007. All of these applications are herein incorporated by reference in their entirety.

FIELD

This invention relates to drill bits, specifically drill bit assemblies for use in oil, gas and geothermal drilling.

BACKGROUND OF THE INVENTION

Often drill bits are subjected to harsh conditions when drilling below the earth's surface. Replacing damaged drill bits in the field is often costly and time consuming since the entire downhole tool string must typically be removed from the borehole before the drill bit can be reached. Bit whirl in hard formations may result in damage to the drill bit and reduce penetration rates. Further, loading too much weight on the drill bit when drilling through a hard formation may exceed the bit's capabilities and also result in damage. Too often, unexpected, hard formations are encountered suddenly and damage to the drill bit occurs before the weight on the drill bit may be adjusted.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and back-rake angle, as well as cutter back-rake, may be varied along the bit profile between the center of the bit and the gauge to provide a less aggressive center and more aggressive outer region on the bit face, to enhance stability while maintaining side cutting capability, as well as providing a high rate of penetration under relatively high weight-on-bit.

U.S. Pat. No. 6,298,930 to Sinor, which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight-on-bit without exceeding the compressive strength of the formation rock.

U.S. Pat. No. 6,363,780 to Rey-Fabret, which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight-on-hook WOH divided by the average instantaneous rotating speed at the surface, Rwob being a function of the standard deviation of the signal of the weight-on-bit WOB estimated by the reduced longitudinal model from measurement of the signal of the weight-on-hook WOH, divided by the average weight-on-bit defined from the weight of the string and the average weight-on-hook. Any danger from the longitudinal behavior of the drill bit is determined from the values of Rf and Rwob.

U.S. Pat. No. 5,806,611 to Van Den Steen, which is herein incorporated by reference for all that it contains, discloses a device for controlling weight-on-bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen, which is herein incorporated by reference for all that is contains, discloses a downhole sensor sub in the lower end of a drillstring, such sub having three orthogonally positioned accelerometers for measuring vibration of a drilling component. The lateral acceleration is measured along either the X or Y-axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight-on-bit, rotary speed, etc.) is then altered to reduce or eliminate such destructive vibration.

BRIEF SUMMARY OF THE INVENTION

In one aspect of the present invention, a drill bit has an axis of rotation and a working face with a plurality of blades extending outwardly from a bit body. The blades form in part an inverted conical region and a plurality of cutters with a cutting surface is arrayed along the blades. A jack element is coaxial with the axis of rotation and extended within the conical region within a range defined by the cutting surface of at least one cutter.

The cutters and a distal end of the jack element may have hard surfaces, preferably over 63 HRc. Materials suitable for either the cutter or the jack element may be selected from the group consisting of diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond cubic boron nitride, chromium, titanium, aluminum, matrix, diamond impregnated matrix, diamond impregnated carbide, a cemented metal carbide, tungsten carbide, niobium, or combinations thereof.

The jack element may have a distal end with a blunt geometry with a generally hemi-spherical shape, a generally flat shape, a generally conical shape, a generally round shape, a generally asymmetric shape, or combinations thereof. The blunt geometry may have a surface area greater than the surface area of the cutting surface. In some embodiments, the blunt geometry's surface is twice as great as the cutting surface.

Depending on the intended application of the bit, various embodiments of the bit may out perform in certain situations. The bit may comprise three to seven blades. Cutters attached to the blades may be disposed at a negative back-rake angle of 1 to 40 degrees. Some of the cutters may be positioned at different angles. For example, the cutters closer to the jack element may comprises a greater back-rake, or vice-versa. The diameter of the cutters may range for 5 millimeters to 50 millimeters. Cutters in the conical region may have larger diameters than the cutters attached to the gauge of the bit, or vice-versa. Cutting surfaces may comprise a generally flat shape, a generally beveled shape, a generally rounded shape, a generally scooped shape, a generally chisel shape, or combinations thereof. Depending on the abrasiveness of the formation back-up cutters may also be desired. The bit may comprise various cone and flange angles as well. Cone angles may range from 25 to 155 degrees and flank angles may range from 5 to 85 degrees. The gauge of the bit may be 0.25 to 15 inches. The gauge may also accommodate 3 to 21 cutters.

The jack element may extend to anywhere within the conical region, although preferably 0.100 to 3 inches. The jack element may be attached within a pocket formed in the working face of the bit. It may be attached to the bit with a braze, a compression fit, a threadform, a bond, a weld, or a combination thereof. In some embodiments, the jack element is formed in the working face. In other embodiments, the jack element may be tapered. In other embodiments, a channel may connect the pocket to a bore of the drill bit. Such a channel may allow air to enter or to exit the pocket when the jack element is inserted or removed and to prevent a suction effect. A portion of the working face may extend adjacent the jack element in such a manner as to support the jack element against radial loads. In some embodiments, the working face has a cross-sectional thickness of 4 to 12 times the cross-sectional thickness of the jack element. The working face may also have 4 to 12 times the cross-sectional area as the jack element.

DETAILED DESCRIPTION OF THE INVENTION

Figure 1:
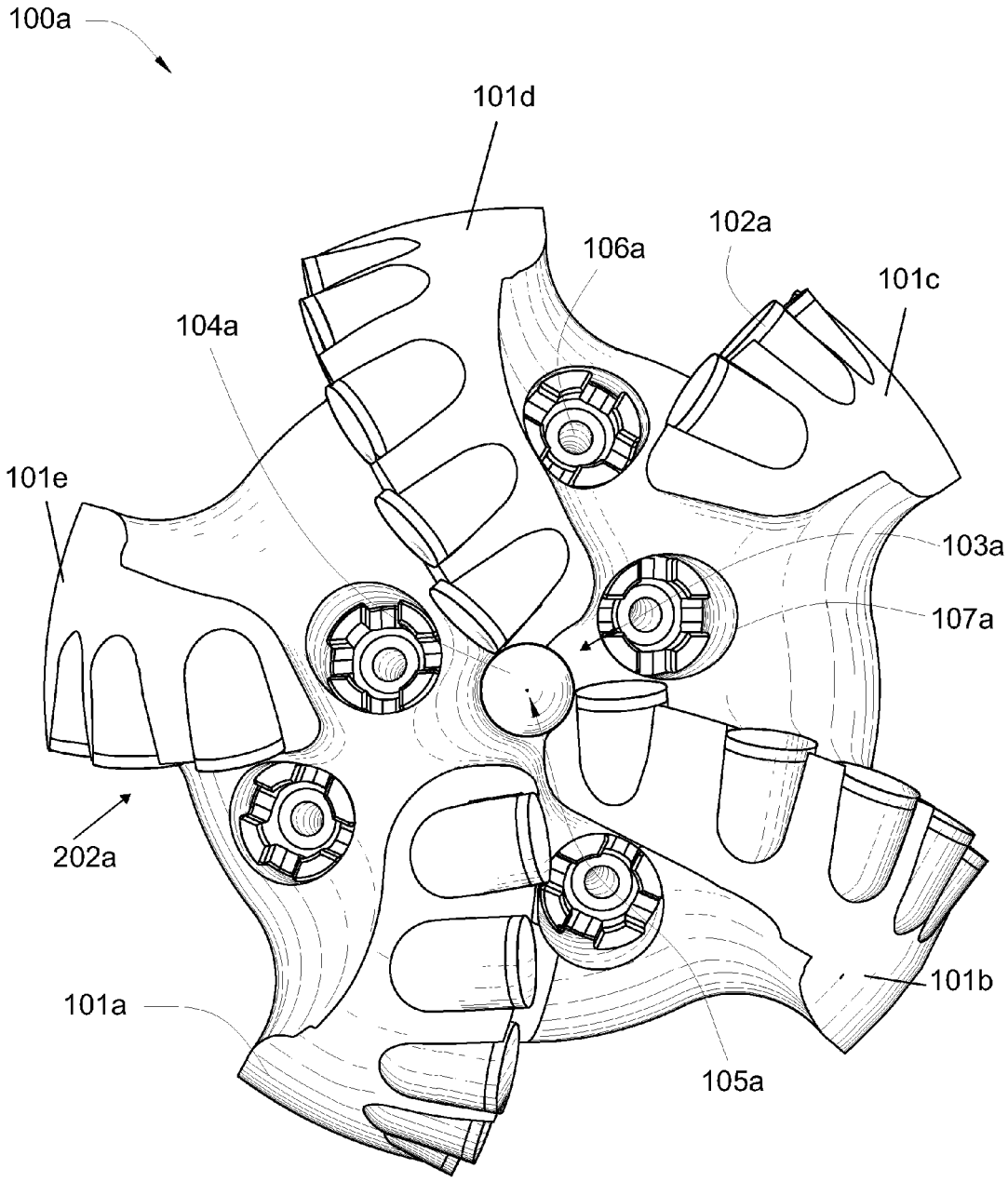
FIG. 1 is a bottom orthogonal diagram of an embodiment of a drill bit.
Figure 2:
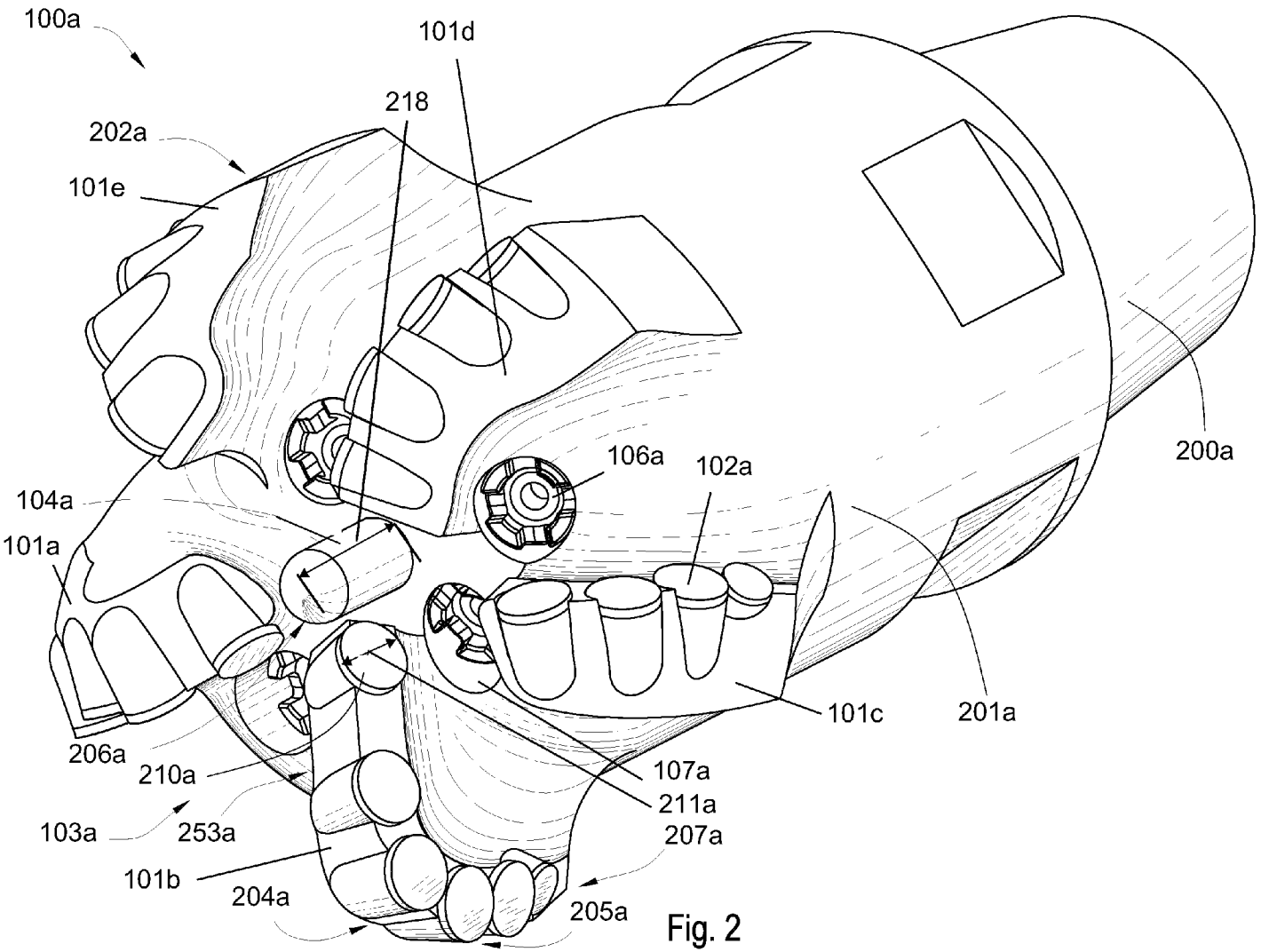
FIG. 2 is a side perspective diagram of the embodiment of the drill bit illustrated in FIG. 1.

FIGS. 1 and 2 disclose a drill bit 100*a* of the present invention. The drill bit 100*a* comprises a shank 200*a*, which is adapted for connection to a downhole tool string, such as drill string made of rigid drill pipe, drill collars, heavy weight pipe, reamers, jars, and/or subs. In some embodiments, coiled tubing or other types of drill strings may be used. The drill bit 100*a* of the present invention is intended for deep oil and gas drilling, although any type of drilling is anticipated such as horizontal drilling, geothermal drilling, mining, exploration, on and off-shore drilling, directional drilling, and any combination thereof.

The drill bit 100*a* includes a bit body 201*a* attached to the shank 200*a* and comprises an end which forms a working face 202*a*. Several blades 101*a*-101*e* extend outwardly from the bit body 201*a*, each of which comprise a plurality of shear cutters 102*a*. The drill bit 100*a* may have at least three blades and, preferably, the drill bit 100*a* will have between three and seven blades. The blades 101*a*-101*e* collectively form an inverted conical region 103*a*. Each blade 101*a*-101*e* may have a cone portion 253*a*, a nose 204*a*, a flank portion 205*a*, and a gauge portion 207*a*. Shear cutters 102*a* may be arrayed along any portion of the blades 101*a*-101*e*, including the cone portion 253*a*, the nose 204*a*, the flank portion 205*a*, and the gauge portion 207*a*.

A jack element 104*a* having a distal end 206*a* is substantially coaxial with an axis 105*a* of rotation of the drill bit 101*a* and extends to a distance 318 from the working face 202*a* to its distal end 206*a* within the inverted conical region 103*a*. The distance 218 that the jack element 104*a* extends falls within a range defined by a diameter 211*a* of a cutting surface 210*a* of at least one of the cutters 102*a*. The cutter 102 may be attached to the cone portion 253 and/or the nose 204 of one of the blades 101.

A plurality of nozzles 106*a* are fitted into recesses 107*a* formed in the working face 202*a*. Each nozzle 106*a* may be oriented such that a jet of drilling mud ejected from the nozzle 106*a* engages a formation before or after the cutters 102*a*. The jets of drilling mud may also be used to clean cuttings away from drill bit 100*a*. In some embodiments, the jets of drilling mud may be used to create a sucking effect to remove drill bit cuttings adjacent the cutters 102*a* and/or the jack element 104*a* by creating a low pressure region within their vicinities.

Figure 3:
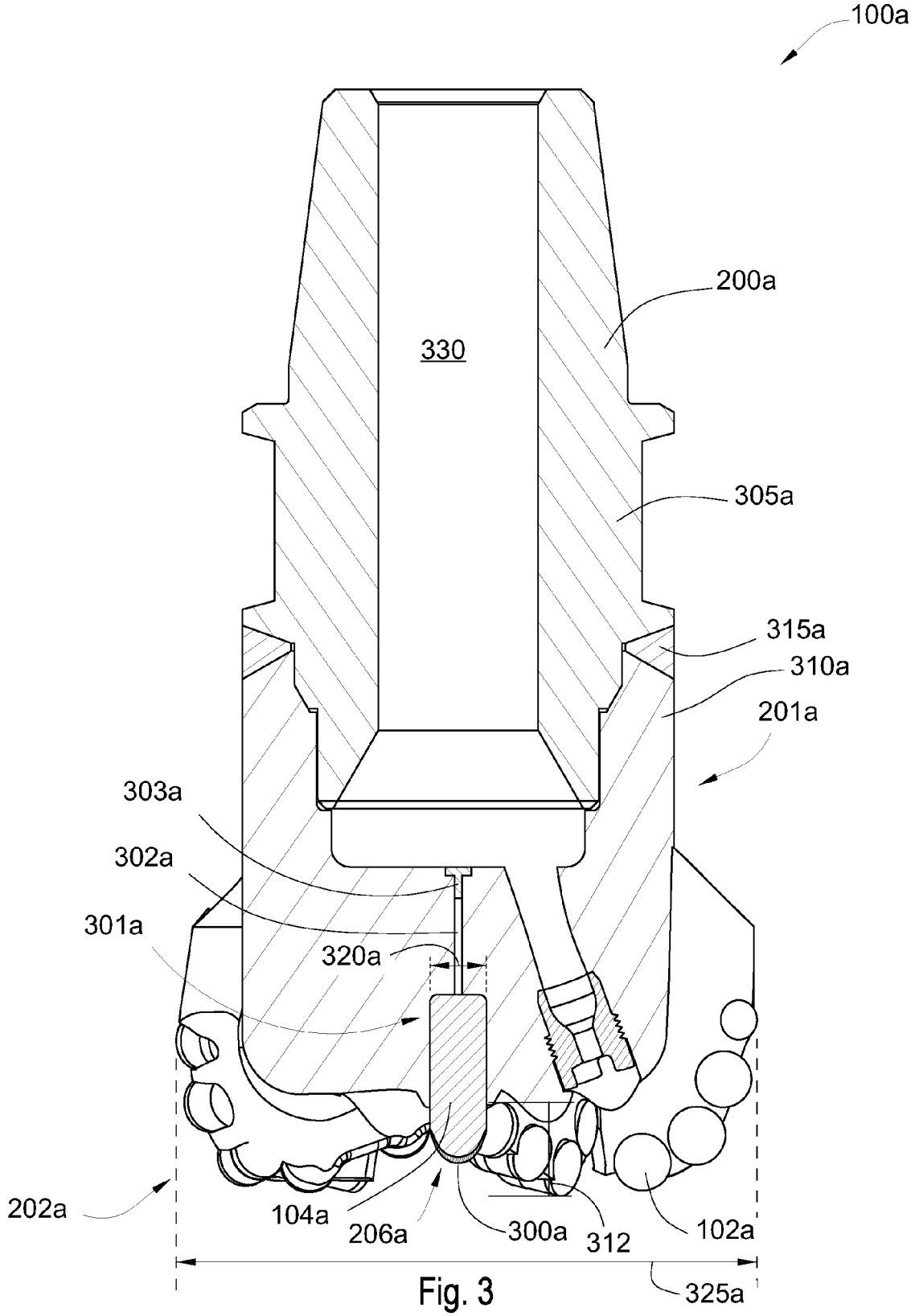
FIG. 3 is a cross-sectional diagram of the embodiment of the drill bit illustrated in FIG. 1.

FIG. 3 discloses a cross-section of an embodiment of the drill bit 100*a*. The jack element 104*a* comprises a hard surface 300*a* of a least 63 HRc. The hard surface 300*a* may be attached to the distal end 206*a* of the jack element 104*a*, but it may also be attached to any portion of the jack element 104*a*. In some embodiments, the jack element 104*a* is made of a material of at least 63 HRc. In the preferred embodiment, the jack element 104*a* comprises tungsten carbide with a hard surface 300*a* of polycrystalline diamond bonded to its distal end 206*a*.

Preferably, the shear cutters 102*a* also comprise a hard surface made of polycrystalline diamond. In some embodiments, the cutters 102*a* and/or distal end 206*a* of the jack element 104*a* comprise a diamond or cubic boron nitride surface. The diamond may be selected from group consisting of polycrystalline diamond, natural diamond, synthetic diamond, vapor deposited diamond, silicon bonded diamond, cobalt bonded diamond, thermally stable diamond, polycrystalline diamond with a cobalt concentration of 1 to 40 weight percent, infiltrated diamond, layered diamond, polished diamond, course diamond, fine diamond or combinations thereof. In some embodiments, the jack element 104 is made primarily from a cemented carbide with a binder concentration of 1 to 40 weight percent, preferably of cobalt.

The working face 202*a* of the drill bit 100*a* may be made of a steel, a matrix, or a carbide as well.

The cutters 102*a* or the distal end 206*a* of the jack element 104*a* may also be made out of hardened steel or may comprise a coating of chromium, titanium, aluminum or combinations thereof.

The jack element 104*a* may be disposed within a pocket 301*a* formed in the bit body 201*a*. The jack element 104*a* is brazed, press fit, welded, threaded, nailed, or otherwise fastened within the pocket 301*a*. In some embodiments, the tolerances are tight enough that a channel 302*a* connected to a bore 330 of the drill bit 100*a* is desirable to allow air to escape upon insertion of the jack element 104*a* into the pocket 301*a* and to allow air to fill in the pocket 301*a* upon removal of the jack element 104*a*. A plug 303 may be used to isolate the internal pressure of the drill bit 100*a* from the pocket 301*a*. In some embodiments, there is no pocket 301*a* and the jack element 104*a* is attached to a flat portion of the working face 202*a*.

The drill bit 100*a* may be made in two portions. The first portion 305*a* may comprise at least the shank 200*a* and a part of the bit body 201*a*. The second portion 310*a* may comprise the working face 202*a* and at least another part of the bit body 201*a*. The two portions 305*a*, 310*a* may be welded together or otherwise joined together at a joint 315*a*.

A diameter 320*a* of the jack element 104*a* may affect its ability to lift the drill bit 100*a* in hard formations. Preferably, the working face 202*a* comprises a cross-sectional thickness, or diameter, 325*a* of 4 to 12 times a cross-sectional thickness, or diameter, 320*a* of the jack element 104*a*. Preferably, the working face 202*a* comprises a cross-sectional area of 4 to 12 times a cross-sectional area of the jack element 104*a*.

Figure 4:
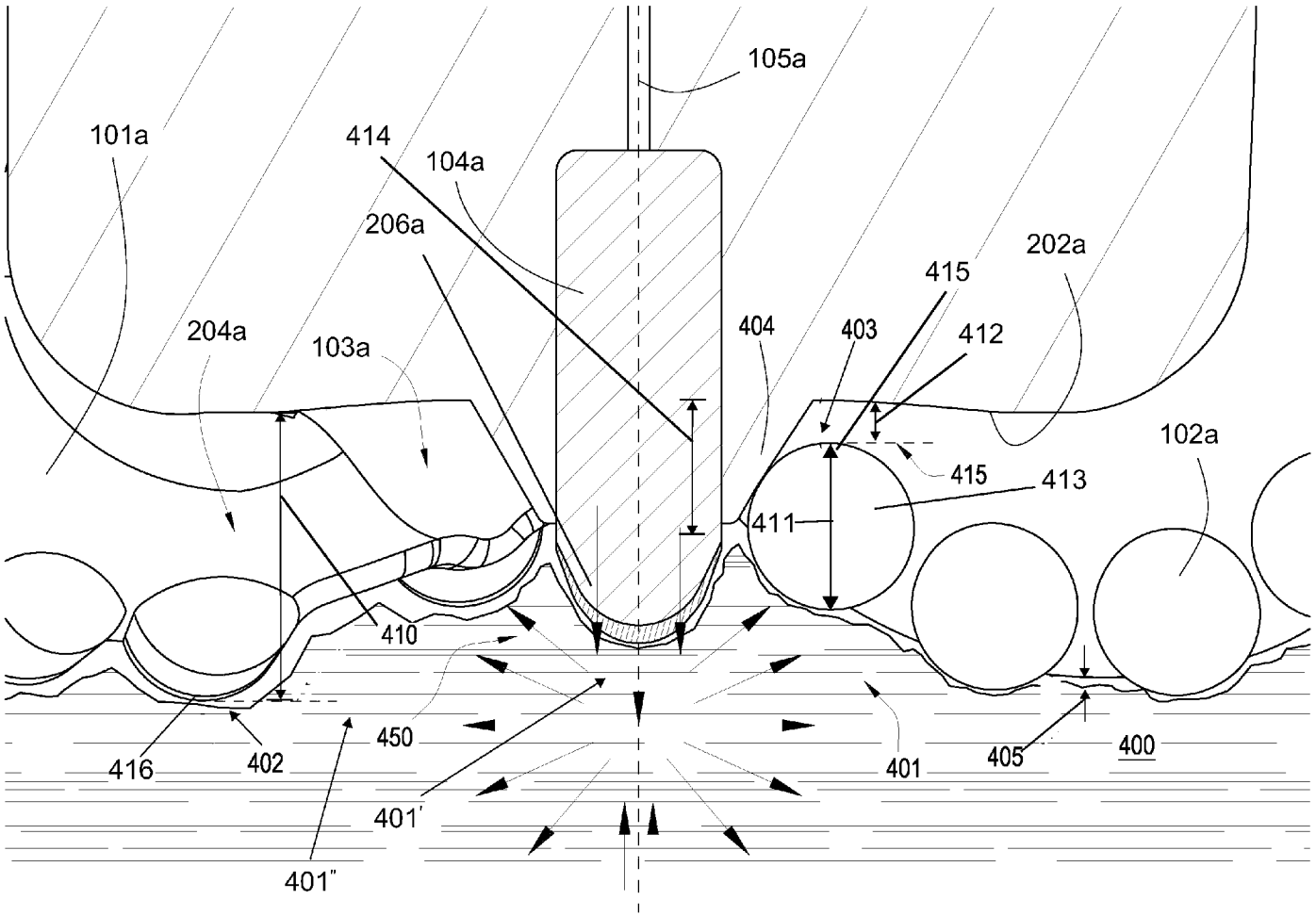
FIG. 4 is a cross-sectional diagram of the embodiment of the drill bit and jack element illustrated in FIG. 1 engaging a formation.

FIG. 4 discloses the drill bit 100*a* in which the jack element 104*a* engages a formation 400. Preferably the formation 400 is the bottom of a well bore. The effect of the jack element 104*a* on the formation 400 may depend on the hardness of the formation 400 and also the weight loaded to the drill bit 100*a*, which is typically referred to as weight-on-bit, or WOB. A feature of the present invention is the ability of the jack element 104*a* to share at least a portion of the WOB with the blades 101*a*-101*e* and/or cutters 102*a*. One feature that allows the jack element 104*a* to share at least a portion of the WOB is that the distal end 206*a* has a blunt geometry 450.

One long standing problem in the industry is that cutters, such as diamond cutters, chip or wear in hard formations when a drill bit is used too aggressively. To minimize cutter damage, a driller will reduce the rotational speed of the bit, but all too often a hard formation is encountered before it is detected and before the driller has time to react.

With the present invention, the jack element 104*a* may limit the depth of cut that the drill bit 100*a* may achieve per rotation in hard formations because the jack element 104*a* actually jacks the drill bit 100*a* thereby slowing its penetration in the unforeseen hard formations. If the formation is soft, the formation may not be able to resist the WOB loaded to the jack element 104*a* and a minimal amount of jacking may take place. But in hard formations, the formation may be able to resist the jack element 104*a*, thereby lifting the drill bit 100*a* as the cutters 102*a* remove a volume of the formation during each rotation. As the drill bit 100*a* rotates and more volume is removed by the cutters 102*a* and drilling mud, less WOB will be loaded to the cutters 102*a* and more WOB will be loaded to the jack element 104*a*. Depending on the hardness of the formation 400, enough WOB will be focused immediately in front of the jack element 104*a* such that the hard formation will compressively fail, weakening the hardness of the formation and allowing the cutters 102*a* to remove an increased volume with a minimal amount of damage.

Typically, WOB is precisely controlled at the surface of the well bore to prevent over loading the drill bit. In experimental testing at the D.J. Basin in Colorado, crews have added about 5,000 more pounds of WOB to embodiments of the drill bit disclosed herein than typically applied to other drill bits. The crews use a downhole mud motor in addition to a top-hole motor to turn the drill string.

Since more WOB increases the depth-of-cut of the cutters on a drill bit, the WOB added will also increase the traction at the drill bit, which will increase the torque required to turn the drill bit. Too much torque can be harmful to the motors rotating the drill string. Surprisingly, the crews in Colorado discovered that the additional 5,000 pounds of WOB did not significantly add much torque to their motors.

This finding from the DJ Basin is consistent with the findings of a test conducted at the Catoosa Test Facility in Rogers County, Okla., where the addition of 10,000 to 15,000 pounds of WOB did not add the expected torque to their motors either.

The minimal increase of torque on the motors is believed to be effected by the jack element 104*a*. It is believed that as the WOB increases the jack element 104*a* jacks the drill bit 100*a* and then compressively fails the formation 400 in front of the drill bit 100*a* by focusing the WOB to the small region in front of the jack element 104*a*, thereby weakening the rest of the formation 400 in the proximity of the working face 202*a*. By jacking the drill bit 100*a*, the depth of cut of the cutters 102 *a* is limited until the compressive failure of the formation 400 takes place, leaving the formation 400 relatively weaker or softer. This, in turn, causes less torque to be required to drill. It is believed that the shearing failure and the compressive failure of the formation 400 happen simultaneously.

As the cutters 102*a* along the inverted conical region 103*a* of the drill bit 100*a* remove portions of the formation 400, a conical profile 401 in the formation 400 may be formed. As the jack element 104*a* compressively fails the conical profile 401, the formation 400 may be pushed towards the cutters 102*a* of the inverted conical region 103*a* of the blades 101*a*-101*e*. Since cutting at the axis of rotation 105*a* is typically the least effective (where the rotational velocity of the cutter 102*a* is lowest), the present invention provides an effective structure and method for increasing the rate of penetration (ROP).

It is believed that it is easier to compressively fail and displace the conical profile 401 closer to its tip 401' than at its base 401", since there is a smaller cross-sectional area. If the jack element 104*a* extends too far into the conical profile 401, the cross-sectional area of the conical profile 401 becomes larger, which may cause it to become too hard to effectively compressively fail and/or displace it. If the jack element 104*a* extends beyond a first distance 410 from the working face 202*a* to the leading most, or most distant first point 416 of the leading most cutter 402, i.e., the cutter 402 furthest from the working face 202*a*, the cross-sectional area of the conical profile 401 may become indefinitely large and extremely hard to displace. In some embodiments, the jack element 104*a* extends within a range of 0.100 to 3 inches from the working face 202*a*. In some embodiments, the jack element 104*a* extends a distance 414 from the working face 202*a* that falls within a diameter 411 extending from a point 415 proximate to the working face 202*a* of a cutting surface 413 of a cutter 403 proximate the axis 105*a* of rotation to another point 415'.

As drilling advances, the jack element 104*a* is believed to stabilize the drill bit 100*a* as well. A long standing problem in the art is bit whirl, which is solved by the jack element 104*a* provided that the jack element 104*a* extends beyond the diameter 211*a* of the cutting surface 210*a* of at least one of the cutters 102*a* within the inverted conical region 103*a*, as illustrated in FIG. 2.

Referring back to FIG. 4, the leading most cutter 402 may be attached to the nose 204*a* of at least one of the blades 101*a*. Preferably, the distal end 206*a* of the jack element 104*a* does not extend from the working face 202*a* beyond a distance 410 to the most distant first point 416 of a cutting surface of cutter 402. The trailing most cutter 403 within the inverted conical region 103*a* may be the closest cutter to the axis 105 of rotation. Preferably, the distal end 206*a* of the jack element 104*a* extends at least a second distance 412 from the working face 202*a* to the point 415 of the cutting surface 413 of the cutter 403 that is proximate to the axis 105*a* of rotation. This distance from the point 415 to the point 410 in which the distal end 206*a* of jack element 104*a* extends from the working face 202*a* is illustrated in FIG. 3 as distance 312. In some embodiments, the jack element 104*a* extends into a region defined as the depth of cut 405 of at least one cutter, which may be the cutter 403 proximate the axis 105*a* of rotation or other cutters 102*a*.

Surprisingly, if the jack element 104*a* does not extend beyond the distance 412, it was found that the drill bit 100*a* was only as stable as the typical commercially available shear bits. During testing it was found in some situations that if the jack element 104*a* extended too far, it would be too weak to withstand radial forces produced from drilling or the jack element 104*a* would reduce the depth-of-cut per rotation greater than desired.

Figure 11:
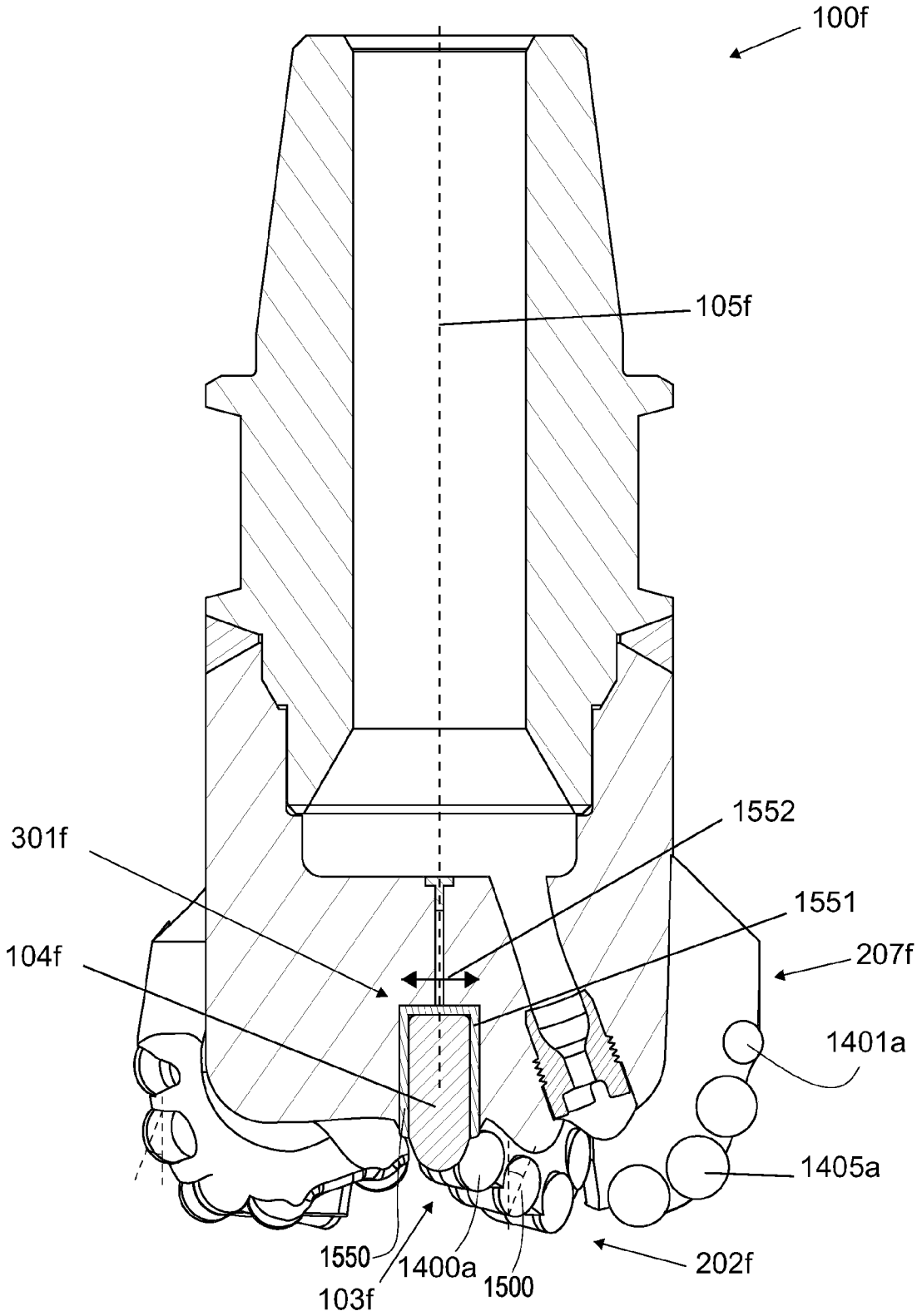
FIG. 11 is a cross-sectional diagram of another embodiment of a drill bit.

Referring to FIG. 11, one indication that stability of the drill bit 10*f* is achieved by the jack element 104*f* is the reduction of wear on the gauge cutters 1401*a* (illustrated in FIG. 11 on an embodiment of a drill bit 1000. In the test conducted at the Catoosa Test Facility in Rogers County, Okla. the present invention was used to drill a well of 780 ft in 6.24 hours through several formations that included mostly sandstone and limestone. During this test, it was found that there was little to no wear on any of the polycrystalline diamond cutters 1401*a* fixed to a gauge portion 207*f* of the drill bit 100*f*, which was not expected, especially since the gauge cutters 1401*a* were not leached and the gauge cutters 1401*a* had an aggressive diameter size of 13 millimeters, while the cutters 1400*a* in the inverted conical region 103*f* had 19 millimeter cutters. It is believed that this reduced wear indicates that there was significantly reduced bit whirl and that the drill bit 100*f* drilled a substantially straight hole. The tests conducted in Colorado also found that the gauge cutters of that drill bit suffered little or no wear.

Referring back to FIG. 4, an extension 404 of the working face 20*a* of the drill bit 100*a* forms a support around a portion of the jack element 104*a*. Because the nature of drilling produces lateral loads, the jack element 104*a* must be robust enough to withstand them. The support from the extension 404 may provide the additional strength needed to withstand the lateral loads.

Figure 5:
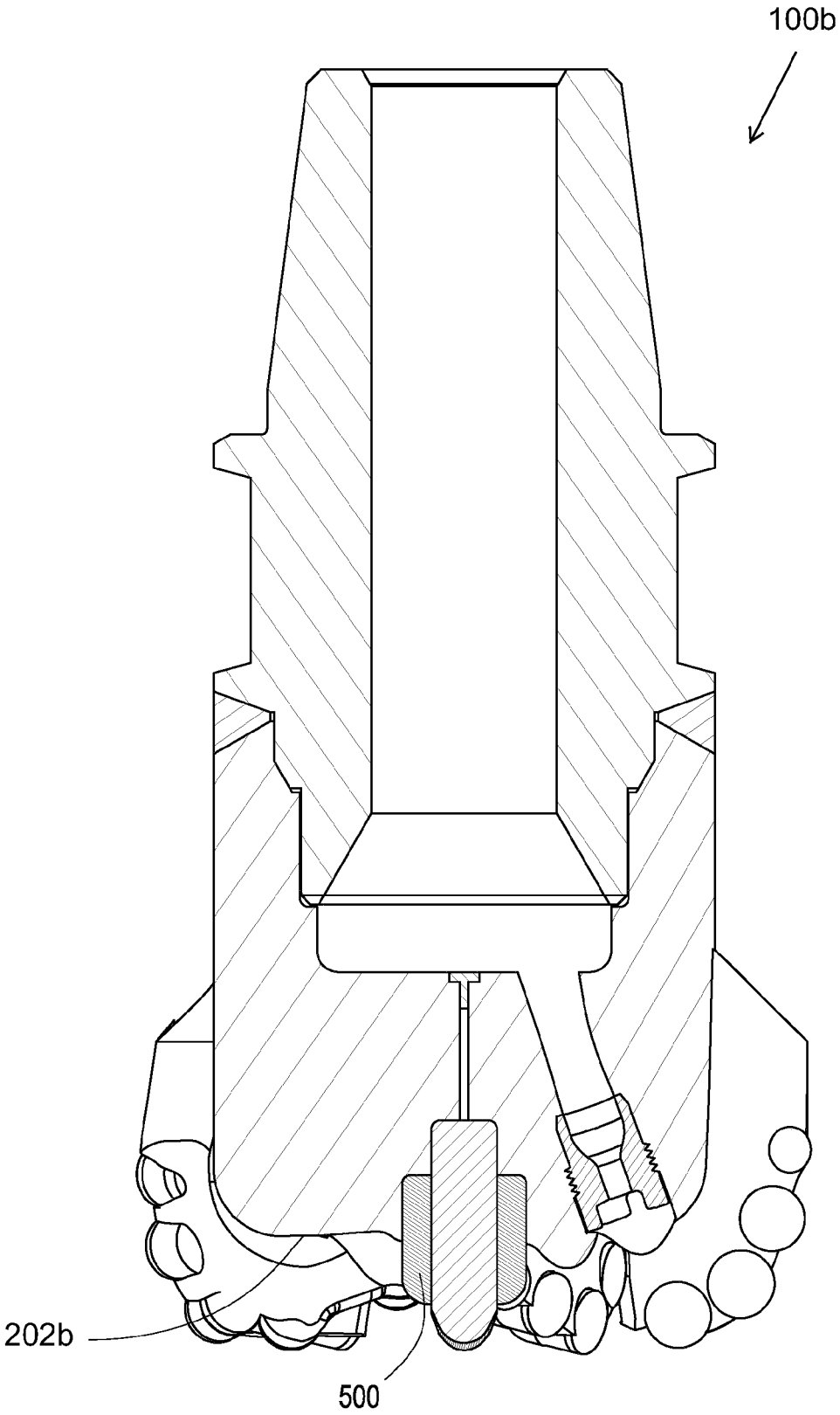
FIG. 5 is a cross-sectional diagram of another embodiment of a drill bit.

Referring to FIG. 5, another embodiment of a drill bit 100*b* uses a ring 500 welded or otherwise bonded to a working face 202*b* of the drill bit 100*b* to give the extra support to resist lateral loads. The ring 500 may be made of tungsten carbide or another material with sufficient strength. In some embodiments, the ring 500 is made a material with a hardness of at least 58 HRc.

Figure 6:
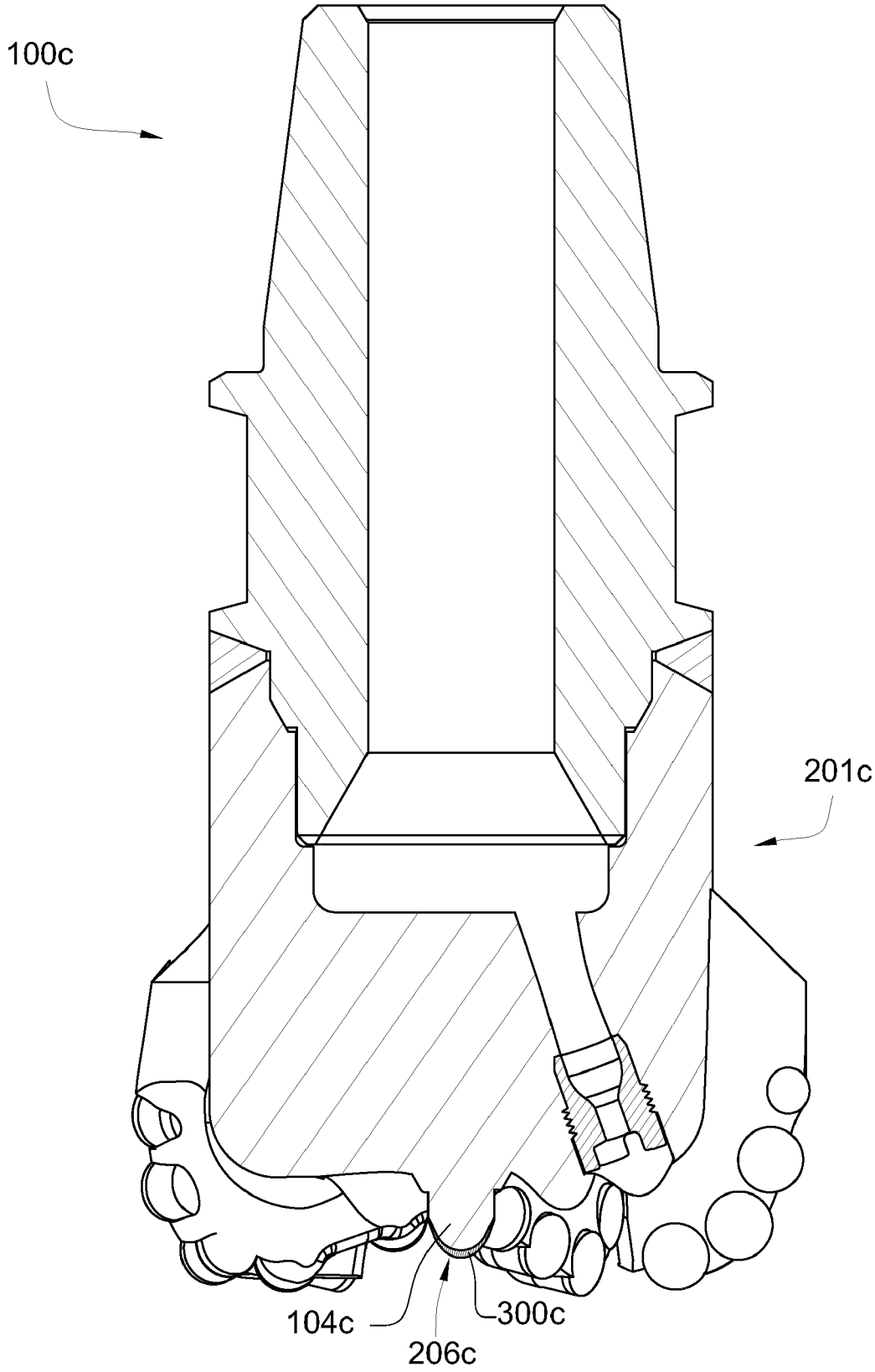
FIG. 6 is a cross-sectional diagram of another embodiment of a drill bit.

FIG. 6 discloses another embodiment of a drill bit 100*c* that a jack element 104*c* formed out of the same material as a bit body 201*c*. The distal end 206*c* of the jack element 104*c* may be coated with a hard material 300*c* to reduce wear. Preferably the jack element 104*c* comprises a blunt distal end 206*c*. The bit body 201*c* and the jack element 104*c* may be made of steel, hardened steel, matrix, tungsten carbide, other ceramics, or combinations thereof. The jack element 104*c* may be formed out of the bit body 201*c* through electric discharge machining (EDM) or on a lathe.

Figure 7:
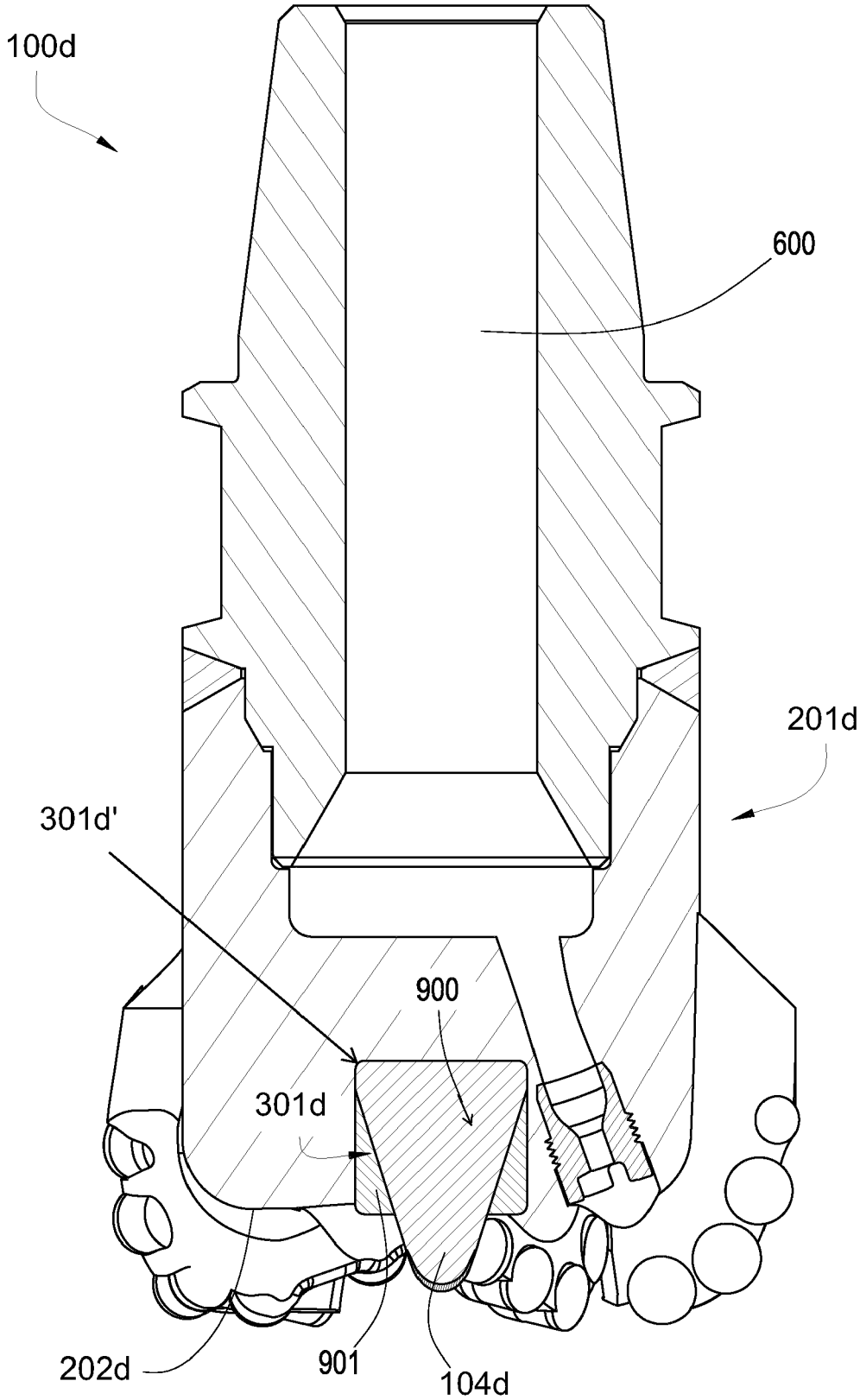
FIG. 7 is a cross-sectional diagram of another embodiment of a drill bit.

FIG. 7 discloses another embodiment of a drill bit 100*d* that includes a tapered jack element 104*d*. In the embodiment of FIG. 7, the entire jack element 104*d* is tapered, although in some embodiments only a portion or portions of the jack element 104*d* may be tapered. A tapered jack element 104*d* may provide additional support to the jack element 104*d* by preventing buckling or helping resist lateral forces exerted on the jack element 104*d*.

In such embodiments of drill bit 100*d*, the jack element 104*d* may be inserted from either the working face 202*d* or the bore 600 of the drill bit 100*d*. In either situation, a pocket 301*d* is formed in a bit body 201*d* and the tapered jack element 104*d* is inserted. Additional material is then added into the exposed portion of the pocket 301*d* after the tapered jack element 104*d* is added. The additional material may comprise the geometry of the exposed portion of the pocket 301*d*, such as a cylinder, a ring, or a tapered ring. In the embodiment of FIG. 7, the tapered jack element 104*d* is insertable from the working face 202*d*. A proximal end 900 of the jack element 104*d* is brazed to a closed end 301*d'* of the pocket 301*d*. A tapered ring 901 is then bonded into the remaining portion of the pocket 301*d*. The tapered ring 901 may be welded, friction welded, brazed, glued, bolted, nailed, or otherwise fastened to the bit body 201*d*.

Figure 8:
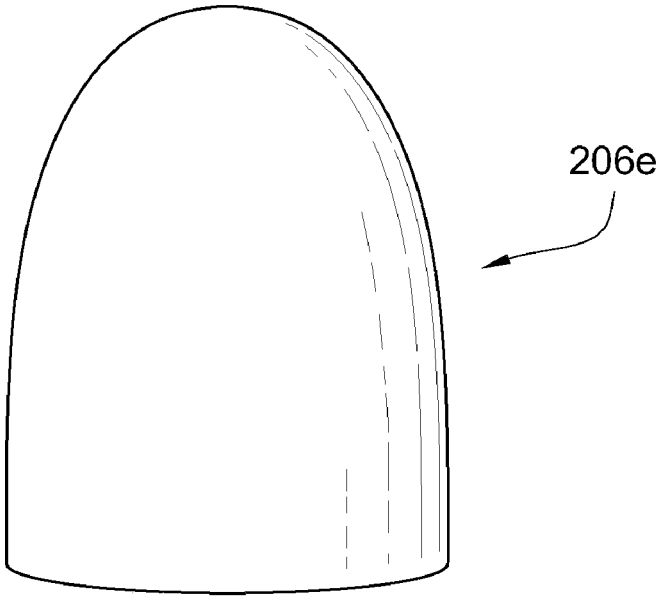
FIG. 8 is a side orthogonal diagram of an embodiment of a distal end of a jack element.
Figure 9:
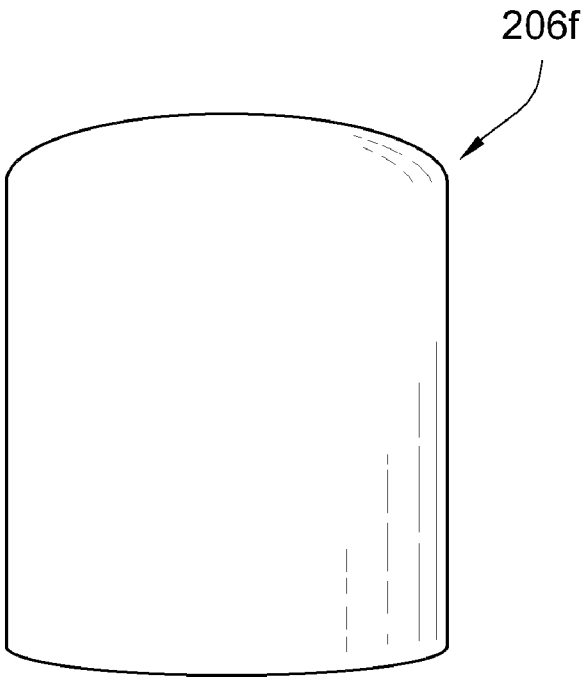
FIG. 9 is a side orthogonal diagram of another embodiment of a distal end of a jack element.

FIGS. 8-9 disclose embodiments of a distal end, such as distal end 206*a* illustrated in FIGS. 2-4. The distal end has a blunt geometry that may comprise a generally hemispherical shape, a generally flat shape, a generally conical shape, a generally round shape, a generally asymmetric shape, or combinations thereof. FIG. 8 illustrates an embodiment of a distal end 206*e* having hemispherical shape. FIG. 9 illustrates an embodiment of a distal end 206*f* having a generally flat shape. The blunt geometry may be defined by the region of the distal end that engages the formation. In some embodiments, the blunt geometry comprises a surface area greater than an area of a cutting surface of one of the cutters 102*a* attached to one of the blades 101. The cutting surface of the cutter 102*a* may be defined as a flat surface of the cutter 102*a*, the area that resists WOB, or in embodiments that use a diamond surface, the diamond surface may define the cutting surface. In some embodiments, the surface area of the blunt geometry is greater than twice the cutter surface of one of the cutters 102*a*.

Figure 10:
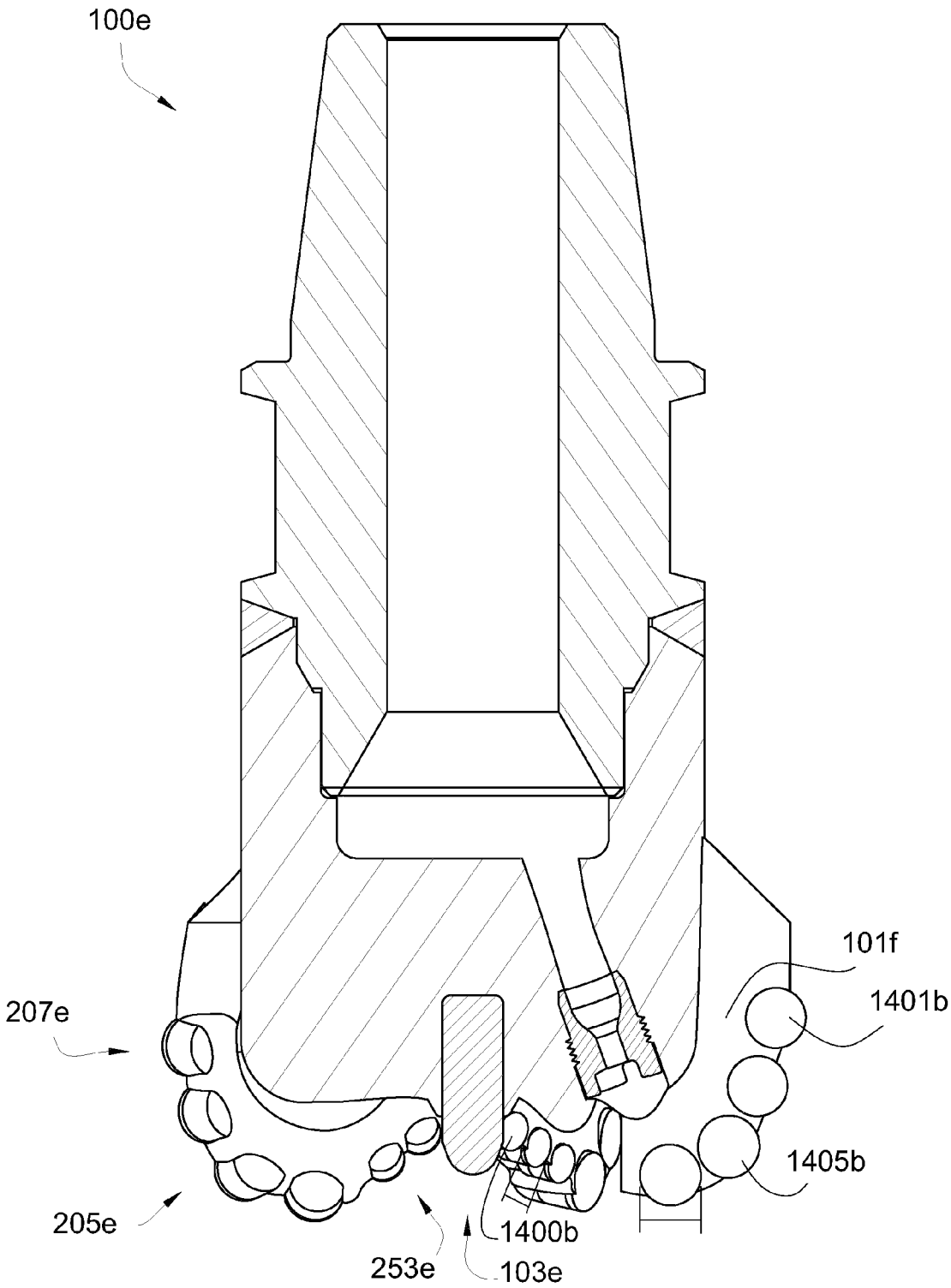
FIG. 10 is a cross-sectional diagram of another embodiment of a drill bit.

FIG. 10 discloses a drill bit 100*e* of the present invention with inner cutters 1400*b* aligned on a cone portion 253*e* of the blades 101*f*. The cutters 1400*b* are smaller than the cutters 1401*b* on a flank portion 205*e* or a gauge portion 207*e* of the drill bit 100*e*. In the testing performed in both Colorado and Oklahoma locations, the inner cutters 1400*b* in an inverted conical region 103*e* received more wear than a flank cutter 1405*b* or the gauge cutters 1401*b*, which is unusual since the rotational velocity of the cutters 1400*b* is less than the rotational velocity of the gauge cutters 1401*b* placed more peripheral to the inner cutters 1400*b*.

Since the inner cutters 1400*b* are now subjected to a more aggressive environment, the cutters 1400*b* may be reduced in size to make the cutters 1400*b* less aggressive. The inner cutters 1400*b* may also be chamfered around their edges to make them less aggressive.

The cutters may have a diameter of 5 millimeters to 50 millimeters. Cutters having a diameter of 13 millimeters to 19 millimeters are more common in the deep oil and gas drilling.

In other embodiments, such as the embodiment of a drill bit 100*f* illustrated in FIG. 11, the inner cutters 1400*a* may be positioned at a greater negative rake-angle 1500 than a flank cutter 1405*a* or a gauge cutter 1401*a* to make them less aggressive. Any of the cutters may comprises a negative rake-angle 1500 of 1 degree to 40 degrees. In some embodiments of the present invention, only the inner most cutter on each blade has a reduced diameter relative to the other cutters or only the inner most cutter on each blade may be set at a relatively more negative rake-angle than the other cutters.

FIG. 11 also discloses a sleeve 1550 which may be brazed into a pocket 301*f* formed in a working face 202*f*. When the braze material cools the sleeve 1550 may misalign from the axis 105*f* of rotation. A bore 1551 having an inner diameter 1552 of the sleeve 1550 may be machined after the sleeve 1550 has cooled, so that the bore 1551 is coaxial with the axis 105*f* of rotation. Then, the jack element 104*f* may be press fit into the bore 1551 of the sleeve 1550 and be coaxial with the axis 105*f* of rotation. A jack element 104*f* may then be press fit into the sleeve 1550. Instead of brazing the jack element 104*f* directly into the working face 202*f*, in some embodiments it may be advantageous to braze the jack element 104*f* to the sleeve 1550.

Figure 12:
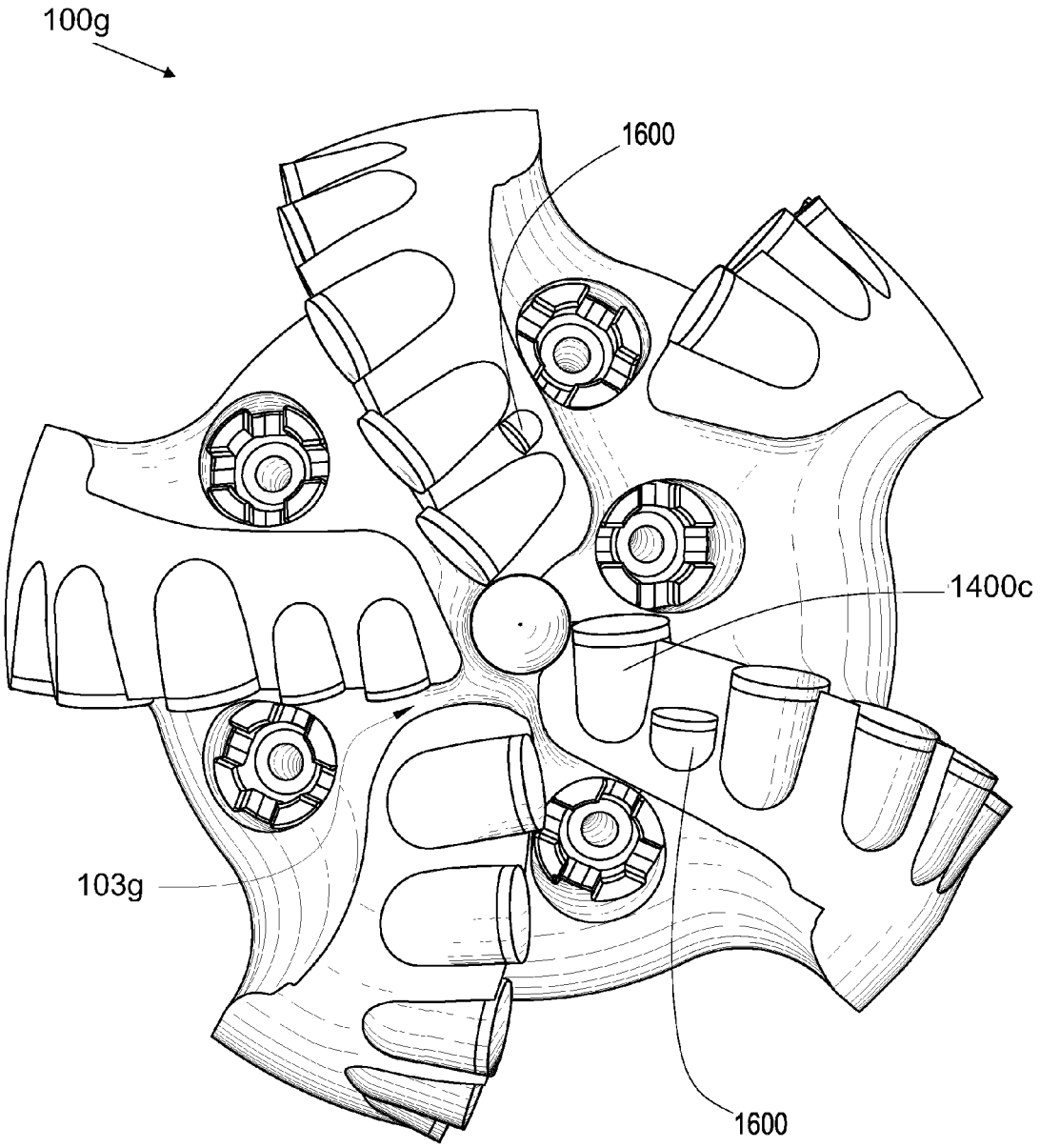
FIG. 12 is a bottom orthogonal diagram of another embodiment of a drill bit.

FIG. 12 discloses another embodiment of a drill bit 100*g* where more cutters 1400*c* in an inverted conical region 103*g* have been added. This may reduce the volume that each cutter 1400*c* in the inverted conical region 103*g* removes per rotation, which may reduce the forces felt by the inner cutters 1400*c*. Back-up cutters 1600 may be positioned between the inner cutters 1400*c* to prevent blade washout.

Figure 13:
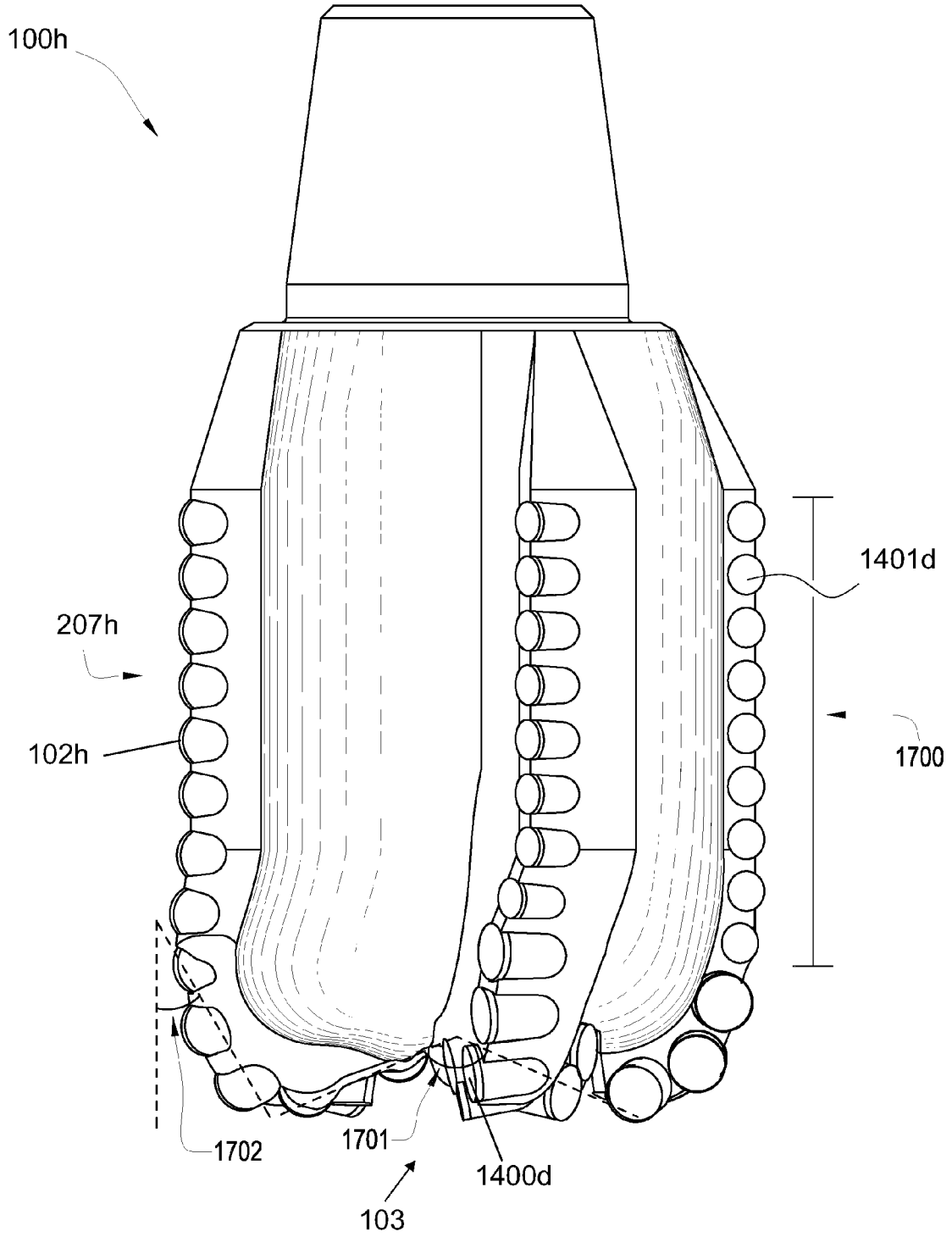
FIG. 13 is a side orthogonal diagram of another embodiment of a drill bit.

FIG. 13 discloses an embodiment of a drill bit 100*h* with a long gauge length 1700. A long gauge length 1700 is believed to help stabilize the drill bit 100*h*. A long gauge length 1700 in combination with a jack element, such as jack element 104*a* illustrated in FIGS. 1-4, may help stabilize the drill bit 100*h*. The gauge length 1700 may be 0.25 to 15 inches long. In some embodiments, the gauge portion 207*h* may comprise 3 to 21 cutters 102*h*. The cutters 102*h* may have several geometries to help make them more or less aggressive depending on their position on the drill bit 100*h*. Some of these geometries may include a generally flat shape, a generally beveled shape, a generally rounded shape, a generally scooped shape, a generally chisel shape or combinations thereof. In some embodiments, the gauge cutters 1401*d* may comprise a small diameter than the cutters 1400*d* attached within the inverted conical region 103*h*.

FIG. 13 also discloses a cone angle 1701 and a flank angle 1702 of the drill bit 100*h*. The cone angle 1701 and the flank angle 1702 may be adjusted for different formations and different applications. Preferably, the cone angle 1701 may be anywhere from 25 degrees to 155 degrees and the flank angle 1702 may be anywhere from 5 degrees to 85 degrees.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:
- a shank;
- a bit body attached to said shank, said bit body having an axis of rotation, said bit body including:
  - a working face having a plurality of blades extending outwardly therefrom, said plurality of blades forming an inverted conical region;
  - a plurality of cutters positioned on said plurality of blades, said plurality of cutters including:
    - a first cutter having a first point most distant from said working face relative to said plurality of cutters;
    - a second cutter proximate said axis of rotation, said second cutter having a another point nearest said working face relative to said plurality of cutters;
  - a pocket formed within said working face;
  - a channel connecting said pocket to a bore of said drill bit; and,
  - a jack element disposed within said pocket, said jack element having a distal end within said inverted conical region, said distal end extending away from said working face a distance between said first point and said second point, said jack element limiting a depth to which at least one of said plurality of cutters engages a formation.

2. The drill bit of claim 1, wherein said distal end includes a surface comprising a material with a hardness of at least 63 HRc.

3. The drill bit of claim 1, wherein said working face has a cross-sectional area that is from about 4 times to about 12 times a cross-sectional area of said jack element.

4. The drill bit of claim 1, wherein said distal end of said jack element extends away from said working face a distance from about 0.100 inches to about 3 inches.

5. The drill bit of claim 1, wherein said jack element is tapered.

6. The drill bit of claim 1, wherein said jack element is press-fit into a sleeve, said sleeve being brazed into said pocket.

7. A drill bit, comprising:
- a shank;
- a bit body attached to said shank, said bit body having an axis of rotation, said bit body including:
  - a working face having a plurality of blades extending outwardly therefrom, said blades forming an inverted conical region;
  - a plurality of cutters positioned on said plurality of blades, said plurality of cutters including a cutter proximate said axis of rotation, said cutter having a point nearest said working face relative to said plurality of cutters and a diameter extending therefrom to another point;
- a pocket formed within said working face;
- a channel connecting said pocket to a bore of said drill bit; and,
- a jack element disposed within said pocket, said jack element having a distal end within said inverted conical region, said distal end extending away from said working face a distance that falls between said point and said another point.

8. The drill bit of claim 7, wherein said jack element is press-fit into a sleeve, said sleeve being brazed into said pocket.

9. A drill bit, comprising:

a shank;

a bit body attached to said shank, said bit body having an axis of rotation, said bit body including:

a working face having a plurality of blades extending outwardly therefrom, said blades forming an inverted conical region;

a plurality of cutters positioned on said plurality of blades, said plurality of cutters including at least one cutter configured to a cut a region of a formation to a depth;

a pocket formed within said working face;

a channel connecting said pocket to a bore of said drill bit; and, a jack element disposed within said pocket, said jack element having a distal end within said inverted conical region, said distal end extending away from said working face to a distance within said region.

10. The drill bit of claim 9, wherein said at least one cutter is proximate said axis of rotation, said at least one cutter having a point nearest said working face relative to said plurality of cutters.

11. The drill bit of claim 9, wherein said jack element is press-fit into a sleeve, said sleeve being brazed into said pocket.

12. A drill bit, comprising:

a shank;

a bit body attached to said shank, said bit body having an axis of rotation, said bit body including:

a working face having a plurality of blades extending outwardly therefrom, said blades forming an inverted conical region;

a plurality of cutters positioned on said plurality of blades, said plurality of cutters including a cutter proximate said axis of rotation, said cutter having a point nearest said working face relative to said plurality of cutters and a diameter extending therefrom to another point;

a pocket formed within said working face;

a sleeve brazed into said pocket; and, a jack element press-fit into said sleeve, said jack element having a distal end within said inverted conical region, said distal end extending away from said working face a distance that falls between said point and said another point.

* * * * *